US006177668B1

(12) United States Patent
Hager

(10) Patent No.: US 6,177,668 B1
(45) Date of Patent: Jan. 23, 2001

(54) AXIAL EJECTION IN A MULTIPOLE MASS SPECTROMETER

(75) Inventor: James W. Hager, Mississauga (CA)

(73) Assignee: MDS Inc., Concord (CA)

( * ) Notice: Under 35 U.S.C. 154(b), the term of this patent shall be extended for 0 days.

(21) Appl. No.: 09/087,909

(22) Filed: Jun. 1, 1998

Related U.S. Application Data

(63) Continuation-in-part of application No. 08/736,550, filed on Oct. 24, 1996, which is a continuation-in-part of application No. 08/656,954, filed on Jun. 6, 1996, now abandoned.

(51) Int. Cl.[7] ..... H01J 49/42
(52) U.S. Cl. ..... 250/282; 250/281; 250/288
(58) Field of Search ..... 250/282, 281, 250/288

(56) References Cited

U.S. PATENT DOCUMENTS

| | | | | |
|---|---|---|---|---|
| Re. 34,000 | | 7/1992 | Syka et al. | 250/292 |
| 3,065,640 | | 11/1962 | Langmuir et al. | 73/517 |
| 3,371,204 | | 2/1968 | Brubaker | 250/292 |
| 4,090,075 | | 5/1978 | Brinkman | 59/44 |
| 4,328,420 | | 5/1982 | French | 250/292 |
| 4,731,533 | | 3/1988 | Vestal | 250/292 |
| 4,963,736 | | 10/1990 | Douglas et al. | 250/292 |
| 5,089,703 | | 2/1992 | Schoen et al. | 49/42 |
| 5,179,278 | * | 1/1993 | Douglas | 250/290 |
| 5,381,007 | | 1/1995 | Kelley | 250/282 |
| 5,420,425 | | 5/1995 | Brier et al. | 250/292 |
| 5,479,012 | | 12/1995 | Wells | 250/292 |
| 5,521,382 | * | 5/1996 | Tanaka et al. | 250/292 |
| 5,598,001 | | 1/1997 | Flory et al. | 250/292 |
| 5,679,950 | | 10/1997 | Baba et al. | 250/281 |
| 5,847,386 | * | 12/1998 | Thomson et al. | 250/288 |

FOREIGN PATENT DOCUMENTS

| | | |
|---|---|---|
| 0 738 000 | 10/1996 | (EP) . |
| WO 97 47025 | 12/1997 | (WO) . |

OTHER PUBLICATIONS

P.H. Dawson—Performance Characteristics of an rf–only Quadrupole, published in the International Journal of Mass Spectrometry, vol. 67, p. 267–276 1985.

* cited by examiner

*Primary Examiner*—Bruce C. Anderson
*Assistant Examiner*—Nikita Wells
(74) *Attorney, Agent, or Firm*—Bereskin & Parr

(57) ABSTRACT

A method of operating a mass spectrometer having an elongated multipole rod set, in which a two dimensional RF field radially contains trapped ions in a mass to charge range of interest, and in which the ions are contained axially by a barrier field on an end lens and to which a low voltage DC is applied. Trapped ions are axially mass selectively ejected by taking advantage of the mixing of the degrees of freedom induced by the fringing fields and other anti-harmonicities in the vicinity of the end lens. Thus, ions can be mass selectively ejected at the exit end at the same time as ions are being admitted into the entrance end of the rod set, thereby taking better advantage of the ion flux from a continuous ion source. The axial mass selective ejection is performed by applying an auxiliary AC voltage to the end lens, or to the rods themselves, or both, and by scanning either the auxiliary AC voltage or the RF voltage on the rod set. Trapped ions can be concentrated near the exit lens by applying an axial field in the direction of the lens, or can be depleted by applying the axial field in the opposite direction. The axial field can be oscillated to dissociate trapped ions.

48 Claims, 19 Drawing Sheets

889 kHz, 1ms, 0.02 amu , 587+,# 2: 10 μM Renin Substrate, 889 kHz, amp = 4.5*3, offset = 0.49*3, some dc, smaller ste
Spectrum from 1.01 min ( 141 scans ) from 889 kHz, 1 ms 0.02 amu, 587+, # 2 2.11e4 cps 889 kHz, 1ms, 440+: 10 μM Renin Substrate, 889 kHz, amp = 6.9*3, offset = 0, some dc, smaller step size
Spectrum from 1.03 min ( 116 scans ) from 889 kHz, 1 ms, 440+ 1.10e4 cps 100 pg / µL 0.043 / 0.13 amu # 34: 100 pg / µL Reserpine, no ejection step, 990 kHz, amp = 7.47*3, offset CP minox RO3 = -2.5, ST # 2 to 200 V: 10 μM Renin substrate, 990 kHz, amp = 5.0*3, offset = 0, neg dc, no He, 1e-5 torr al

AXIAL EJECTION IN A MULTIPOLE MASS SPECTROMETER

PRIOR APPLICATION

This application is a continuation-in-part of my application Ser. No. 08/736,550 filed Oct. 24, 1996 entitled "AXIAL EJECTION IN A MULTIPOLE MASS SPECTROMETER", which in turn is a continuation-in-part of my application Ser. No. 08/656,954 filed Jun. 6, 1996 under the same title (now abandoned).

FIELD OF THE INVENTION

This invention relates to a multipole elongated rod ion trap mass spectrometer with mass dependent axial ejection.

BACKGROUND OF THE INVENTION

Conventional ion traps, of the kind described in U.S. Pat. No. 2,939,952, are generally composed of three electrodes, namely a ring electrode, and a pair of end caps, with appropriate RF and DC voltages applied to these electrodes to establish a three-dimensional field which traps ions within a mass range of interest in the relatively small volume between the ring electrode and the end caps. The electrodes may be hyperbolic, producing a theoretically perfect three-dimensional quadrupole field, or they may deviate from hyperbolic geometry, giving rise to additional multipole fields superimposed on the quadrupole field and which can produce improved results.

Usually ion trap mass spectrometers are filled in an essentially mass-independent manner and are emptied mass-dependently by manipulating the RF and DC voltages applied to one or more of the electrodes. The ion storage and fast scanning capabilities of the ion trap are advantageous in analytical mass spectrometry. High analysis efficiency, compared to typical beam-type mass spectrometers, can be achieved if the time to eject and detect ions from the trap is smaller than the time required to fill a trap. If this condition is met, then very few ions are wasted.

However an inherent disadvantage of ion traps is that ion transport into the trap is usually of very low efficiency, e.g. one to ten percent, primarily due to the relatively small volume of the trap and the very demanding ion energetic constraints for trap acceptance of externally generated ions. The relatively small volume of the ion trap means that the number of ions that can be accepted before space charge effects become serious is also relatively small. Increasing the radial dimension of the volume of the trapping chamber of a conventional ion trap partially overcomes this limitation, but with the additional disadvantages of reduced analytical utility and/or increased costs (e.g. reduced mass range, larger power supplies). The small volume of the ion trapping chamber will also tend to limit the linear response range (i.e. dynamic range), again because of the effects of space charge at high ion densities.

An additional problem is that when a conventional ion trap is performing an analysis, no additional ions can be accepted. For many modern ion sources such as electrospray, ion spray (disclosed in U.S. Pat. No. 4,861,988), or corona discharge, this can be a considerable disadvantage because the trap fill time is usually short compared with the analysis time. Consequently, and as described in U.S. Pat. No. 5,179,278 assigned to the assignee of the present invention, many ions can be wasted during the analysis time, resulting in relatively low duty cycles.

It is known that ions can be trapped and stored very efficiently in a two-dimensional RF quadrupole. In some cases ions have been admitted into and then trapped in a two-dimensional quadrupole for purposes of releasing them into a conventional ion trap, as shown in U.S. Pat. No. 5,179,278. More generally ions have been admitted into a pressurized linear cell or a two-dimensional RF quadrupole for the purpose of studying ion molecule reactions. Generally the ions enter the device from a mass selective source such as a resolving quadrupole, are trapped for a specified period of time, and then are ejected mass-independently for subsequent mass analysis.

U.S. Pat. No. 5,420,425 teaches that ions can be trapped and stored in a two-dimensional RF quadrupole and scanned out mass-dependently, using the technique of mass selective instability. According to that patent the device disclosed therein was conceived in order to improve ion sensitivities, detection limits, and dynamic range, by increasing the volume of the trapping chamber in the axial dimension. The mass selective instability mode of ion ejection (and all other mass analysis scanning modes described in U.S. Pat. No. 5,420,425) involve ejecting ions out of the trapping chamber in a direction orthogonal to the center axis of the device, i.e. radially.

There are several disadvantages of radial ejection of ions from a two-dimensional RF quadrupole. One disadvantage is that radial ejection expels ions through or between the quadrupole (or higher order multipole) rods. This forces the ions through regions of space for which there are significant RF field imperfections. The effect of these imperfections is to eject ions at points not predicted by the normal stability diagram.

Radial ejection from a two-dimensional RF quadrupole has the further disadvantage of providing a poor match between the dimensions of the plug of ejected ions and conventional ion detectors. In a linear or curved rod structure, radially ejected ions will exit throughout the length of the device, i.e. with a rectangular cross-section of length corresponding to the rods themselves. Most conventional ion detectors have relatively small circular acceptance apertures (e.g. less than 2 $cm^2$) that are not well-suited for elongated ion sources.

Mass selective instability for radial ion ejection of ions from a two-dimensional RF quadrupole has additional problems. Ions ejected radially from such a device will exit with a diverging spacial profile with a characteristic solid angle. Some of the ejected ions will hit the rods and be lost. In addition, radially ejected ions will leave the trapping structure in opposite directions. Multiple ion detectors would be required to collect all of the ions made unstable by this and similar techniques. Ions ejected away from the detector(s) or which encounter one of the electrodes are lost and therefore do not contribute to the measured ion signal. Therefore only a small fraction of trapped ions would normally be collected, despite the very high storage ability of this device.

BRIEF SUMMARY OF THE INVENTION

Accordingly, it is an object of the present invention in one of its aspects to provide an elongated multipole mass spectrometer which has a high injection efficiency and an enlarged trapping volume, and in which ions are ejected along the major axis of the device, thus allowing a good geometric match with commonly used ion detectors.

In one of its aspects the invention provides a method of operating a mass spectrometer having an elongated rod set, said rod set having an entrance end and an exit end and a longitudinal axis, said method comprising:

(a) admitting ions into said entrance end of said rod set, (b) trapping at least some of said ions in said rod set by producing a barrier field at an exit member adjacent to the exit end of said rod set and by producing an RF field between the rods of said rod set adjacent at least the exit end of said rod set, (c) said RF and barrier fields interacting in an extraction region adjacent to said exit end of said rod set to produce a fringing field, (d) energizing ions in said extraction region to mass selectively eject at least some ions of a selected mass to charge ratio axially from said rod set past said barrier field, (e) and detecting at least some of the ejected ions.

In another aspect, the invention provides a method of operating a mass spectrometer having a plurality of elongated rod sets in series, each rod set having a longitudinal access, and thereby providing MS/MS, said method comprising:

(a) emitting ions from an ion source into one said rod set, (b) pre-trapping ions in said one rod set, (c) selectively pulsing ions from said one rod set into a second said rod set, said second rod set having entrance and exit ends, (d) trapping at least some of said ions in said second rod set by producing a barrier field at an exit member adjacent to the exit end of said second rod set and by producing an RF field between the rods of said second rod set adjacent to at least the exist end of said second rod set, (e) said RF and barrier fields interacting in an extraction region adjacent to said exit end of said second rod set to produce a fringing field, (f) energizing ions in said extraction region to mass selectively eject at least some ions of a selected mass to charge ratio axially from said second rod set past said barrier field, said ejected ions being parent ions, (g) transmitting said parent ions into a third said rod set containing a collision gas, and fragmenting said parent ions in said third rod set to form fragment ions, (h) and mass dependently ejecting at least said fragment ions axially from a said rod set for detection.

Further objects and advantages of the invention will be apparent from the following description, taken together with the accompanying drawings.

DETAILED DESCRIPTION OF PREFERRED EMBODIMENT

Figures 1, 1A:
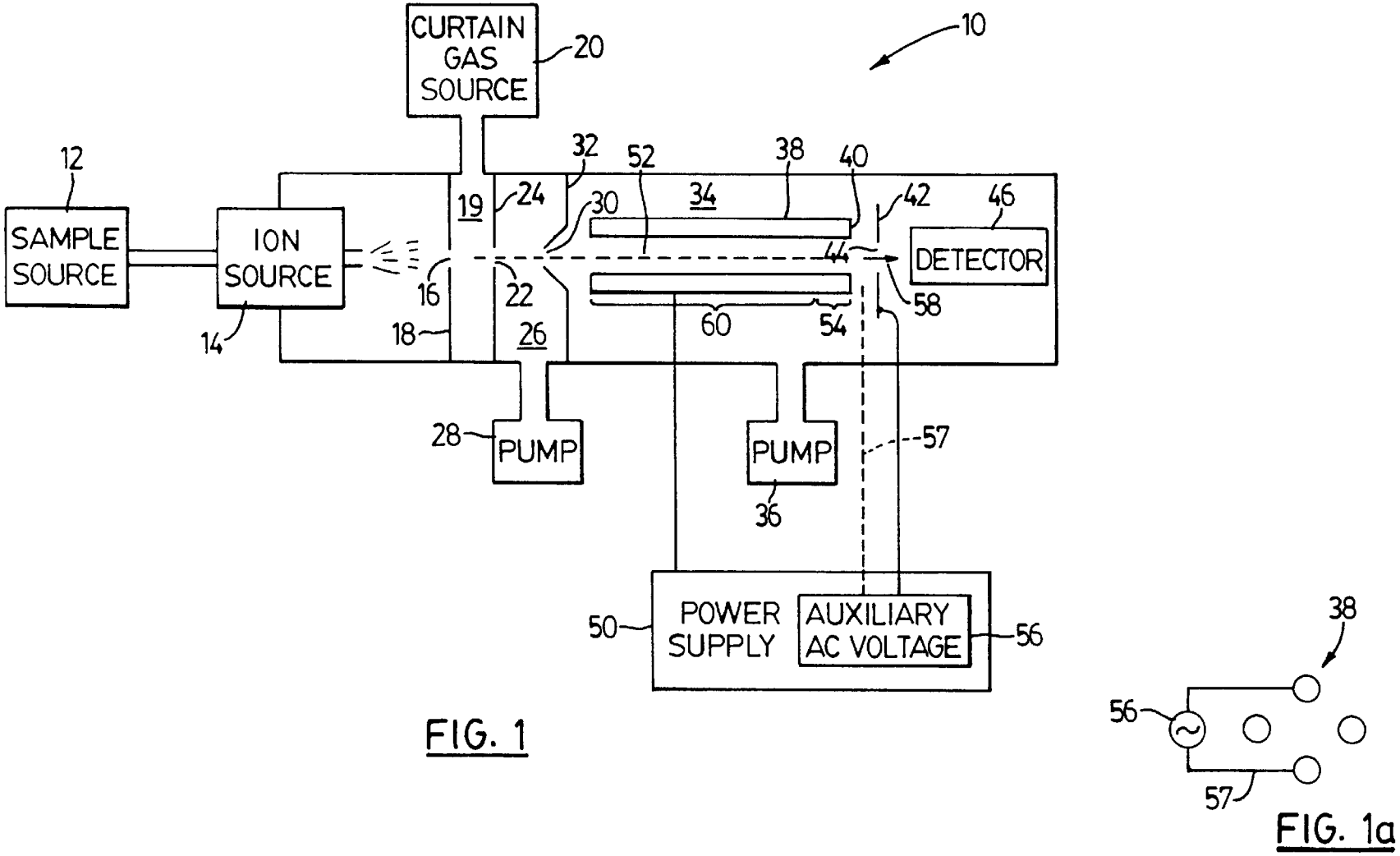
FIG. 1 is a diagrammatic view of a simple mass spectrometer apparatus with which the present invention may be used.
FIG. 1*a* is an end view of a rod set of FIG. 1 and showing electrical connections to such rod set.

Reference is first made to FIG. 1, which shows a mass analyzer system 10 with which the invention may be used. The system 10 includes a sample source 12 (normally a liquid sample source such as a liquid chromatograph) from which sample is supplied to a conventional ion source 14. Ion source 14 may be an electrospray, an ion spray, or a corona discharge device, or any other known ion source. An ion spray device of the kind shown in U.S. Pat. No. 4,861,988 issued Aug. 29, 1989 to Cornell Research Foundation Inc. is suitable.

Ions from ion source 14 are directed through an aperture 16 in an aperture plate 18. Plate 18 forms one wall of a gas curtain chamber 19 which is supplied with curtain gas from a curtain gas source 20. The curtain gas can be argon, nitrogen or other inert gas and is described in the above-mentioned U.S. Pat. No. 4,861,988. The ions then pass through an orifice 22 in an orifice plate 24 into a first stage vacuum chamber 26 evacuated by a pump 28 to a pressure of about 1 Torr.

The ions then pass through a skimmer orifice 30 in a skimmer plate 32 and into a main vacuum chamber 34 evacuated to a pressure of about 2 milli-Torr by a pump 36.

The main vacuum chamber 34 contains a set of four linear conventional quadrupole rods 38. The rods 38 may typically have a rod radius r=0.470 cm, an inter-rod dimension $r_0$=0.415 cm, and an axial length l=20 cm.

Located about 2 mm past the exit ends 40 of the rods 38 is an exit lens 42. The lens 42 is simply a plate with an aperture 44 therein, allowing passage of ions through aperture 44 to a conventional detector 46 (which may for example be a channel electron multiplier of the kind conventionally used in mass spectrometers).

The rods 38 are connected to the main power supply 50 which applies a DC rod offset to all the rods 38 and also applies RF in conventional manner between the rods. The power supply 50 is also connected (by connections not shown) to the ion source 14, the aperture and orifice plates 18 and 24, the skimmer plate 32, and to the exit lens 42.

By way of example, for positive ions the ion source 14 may typically be at +5,000 volts, the aperture plate 18 may be at +1,000 volts, the orifice plate 24 may be at +250 volts, and the skimmer plate 32 may be at ground (zero volts). The DC offset applied to rods 38 may be −5 volts. The axis of the device, which is the path of ion travel, is indicated at 52.

Thus, ions of interest which are admitted into the device from ion source 14 move down a potential well and are allowed to enter the rods 38. Ions that are stable in the applied main RF field applied to the rods 38 travel the length of the device undergoing numerous momentum dissipating collisions with the background gas. However a trapping DC voltage, typically −2 volts DC, is applied to the exit lens 42. Normally the ion transmission efficiency between the skimmer 32 and the exit lens 42 is very high and may approach 100%. Ions that enter the main vacuum chamber 34 and travel to the exit lens 42 are thermalized due to the numerous collisions with the background gas and have little net velocity in the direction of axis 52. The ions also experience forces from the main RF field which confines them radially. Typically the RF voltage applied is in the order of about 450 volts (unless it is scanned with mass) and is of a frequency of the order of about 816 kHz. No resolving DC field is applied to rods 38.

When a DC trapping field is created at the exit lens 42 by applying a DC offset voltage which is higher than that applied to the rods 38, the ions stable in the RF field applied to the rods 38 are effectively trapped.

However ions in region 54 in the vicinity of the exit lens 42 will experience fields that are not entirely quadrupolar, due to the nature of the termination of the main RF and DC fields near the exit lens. Such fields, commonly referred to as fringing fields, will tend to couple the radial and axial degrees of freedom of the trapped ions. This means that there will be axial and radial components of ion motion that are not mutually orthogonal. This is in contrast to the situation at the center of rod structure 38 further removed from the exit lens and fringing fields, where the axial and radial components of ion motion are not coupled or are minimally coupled.

Because of the fringing fields couple the radial and axial degrees of freedom of the trapped ions, ions may be scanned mass dependently axially out of the ion trap constituted by rods 38, by the application to the exit lens 42 of a low voltage auxiliary AC field of appropriate frequency. (An example of the frequencies that may be used is given later in this description.) The auxiliary AC field may be provided by an auxiliary AC supply 56, which for illustrative purposes is shown as forming part of the main power supply 50.

The auxiliary AC field is an addition to the trapping DC voltage supplied to exit lens 42 and couples to both the radial and axial secular ion motions. The auxiliary AC field is found to excite the ions sufficiently that they surmount the axial DC potential barrier at the exit lens 42, so that they can leave axially in the direction of arrow 58. The deviations in the field in the vicinity of the exit lens 42 lead to the above described coupling of axial and radial ion motions enabling the axial ejection at radial secular frequencies. This is in contrast to the situation existing in a conventional ion trap, where excitation of radial secular motion will generally lead to radial ejection and excitation of axial secular motion will generally lead to axial ejection, unlike the situation described above.

Therefore, ion ejection in a sequential mass dependent manner can be accomplished by scanning the frequency of the low voltage auxiliary AC field. When the frequency of the auxiliary AC field matches a radial secular frequency of an ion in the vicinity of the exit lens 42, the ion will absorb energy and will now be capable of traversing the potential barrier present on the exit lens due to the radial/axial motion coupling. When the ion exits axially, it will be detected by detector 46. After the ion is ejected, other ions upstream of the region 54 in the vicinity of the exit lens are energetically permitted to enter the region 54 and be excited by subsequent AC frequency scans.

Ion ejection by scanning the frequency of the auxiliary AC voltage applied to the exit lens is desirable because it does not empty the trapping volume of the entire elongated rod structure 38. In a conventional mass selective instability scan mode for rods 38, the RF voltage on the rods would be ramped and ions would be ejected from low to high masses along the entire length of the rods when the q value for each ion reaches a value of 0.907. After each mass selective instability scan, time is required to refill the trapping volume before another analysis can be performed. In contrast, when an auxiliary AC voltage is applied to the exit lens as described above, ion ejection will normally only happen in the vicinity of the exit lens because this is where the coupling of the axial and radial ion motions occurs and where the auxiliary AC voltage is applied. The upstream portion 60 of the rods serves to store other ions for subsequent analysis. The time required to refill the volume 54 in the vicinity of the exit lens with ions will always be shorter than the time required to refill the entire trapping volume. Therefore fewer ions will be wasted.

As an alternative, instead of scanning the auxiliary AC voltage applied to end lens 42, the auxiliary AC voltage on end lens 42 can be fixed and the main RF voltage applied to rods 38 can be scanned in amplitude, as will be described. While this does change the trapping conditions, a q of only about 0.2 to 0.3 is needed for axial ejection, while a q of about 0.907 is needed for radial ejection. Therefore, as will be explained, few if any ions are lost to radial ejection if the RF voltage is scanned through an appropriate amplitude range, except possibly for very low mass ions.

As a further alternative, and instead of scanning either the RF voltage applied to rods 38 or the auxiliary AC voltage applied to end lens 42, a further supplementary or auxiliary AC dipole voltage or quadrupole voltage may be applied to rods 38 (as indicated by dotted connection 57 in FIG. 1) and scanned, to produce varying fringing fields which will eject ions axially in the manner described. As is well known, when an auxiliary dipole voltage is used, it is usually applied between an opposed pair of the rods 38, as indicated in FIG. 1*a*.

Alternatively, a combination of some or all of the above three approaches (namely scanning an auxiliary AC field applied to the end lens 42, scanning the RF voltage applied to the rod set 38 while applying a fixed auxiliary AC voltage to end lens 42, and applying an auxiliary AC voltage to the rod set 38 in addition to that on lens 42 and the RF on rods 38) can be used to eject ions axially and mass dependently past the DC potential barrier present at the end lens 42.

The device illustrated may be operated in a continuous fashion, in which ions entering the main RF containment field applied to rods 38 are transported by their own residual momentum toward the exit lens 42 and ultimate axial ejection. Thus, the ions which have reached the extraction volume in the vicinity of the exit lens have been preconditioned by their numerous collisions with background gas, eliminating the need for an explicit cooling time (and the attendant delay) as is required in most conventional ion traps. At the same time as ions are entering the region 60, ions are being ejected axially from region 54 in the mass dependent manner described.

It is noted that the extraction volume 54 in the vicinity of the exit lens is quite small. The exit lens 42 is normally placed very close to the ends of the rods 38, e.g. 2 mm from the rod ends (as mentioned). The penetration of the fringing fields from the exit lens 42 into the space between the rods 38 is believed to be very small, typically of the order of between 0.5 mm and 1.0 mm, so the extent of volume or region 54 is exaggerated in FIG. 1, for clarity of illustration.

As a further alternative, the DC offset applied to all four rods 38 (which in the example given is −5 volts) can be modulated at the same frequency as the AC which would have been applied to exit lens 42. In that case no AC is needed on exit lens 42 since modulating the DC offset is equivalent to applying an AC voltage to the exit lens, in that it creates an AC field in the fringing region. Of course the DC potential barrier is still applied to the exit lens 42. The amplitude of the modulation of the DC offset will be the same as the amplitude of the AC voltage which otherwise would have been applied to the exit lens 42, i.e. it is set to optimize the axially ejected ion signal. Then, either the RF amplitude is scanned to bring ions sequentially into resonance with the AC field created by the DC modulation, or else the frequency of the modulation is scanned so that again, when such frequency matches a radial secular frequency of an ion in the fringing fields in the vicinity of the exit lens, the ion will absorb energy and be ejected axially for detection. The rod offset would not be modulated until after ions have been injected and trapped within the rods, since the modulation would otherwise interfere with ion injection, so this process would be a batch process. This is in contrast to the continuous process possible when AC is placed on the exit lens, in which case ions can be ejected from the extraction region 54 at the same time as ions are entering region 60 (because the AC field on exit lens 42 does not affect ion injection).

The highest efficiency in a continuous mode operation is achieved when the ion ejection rate is faster than the rate at which ions of the desired mass/charge ratio are injected into the rods and travel along them to the exit lens 42. Ion ejection processes can require some tens of milliseconds. The time required for ions to travel from one end to the other of the rods 38 depends on the lengths of the rods themselves, the initial energy of the ions, and the pressure in the vacuum chamber 34. In some cases the end-to-end transit time will dominate, but more often the time required to extract the ions from the region in the vicinity of the exit lens 42 will be more important. Thus it may be desirable to manipulate the axial energy of the ions to afford an optimum match between the time required for the ions to reach the extraction region 54, and the time for the ejection process itself to occur. Further, it may be of utility to be able to control the concentration of ions in the vicinity of the exit lens to reduce or enhance the local charge density in that region, depending on the application.

One method of matching the time required for ions to travel from one end to the other of the rods 38 to the time required to eject the ions is to apply an axial field along the rods 38. Methods for imposing axial fields of this kind are described in application Ser. No. 08/514,372 filed Aug. 5, 1995 and entitled "Spectrometer with Axial Field" (abandoned parent of application Ser. No. 08/796,582 filed Feb. 6, 1997, which issued as U.S. Pat. No. 5,847,386 on Dec. 8, 1998 to Thomson et al. and which is assigned to the assignee of this application). An applied axial field in the direction of the exit lens 42 will tend to concentrate ions in the region of rods 38 in the vicinity of lens 42, i.e. in the volume 54 of the device from which the ions are extracted. An applied axial field in the opposite direction will tend to deplete ions from the extraction volume 54, and may also be desirable in some cases.

Several techniques are available as described in the above identified application Ser. No. 08/514,372 for providing an axial field by modification of the electrode geometries. Such arrangements include tapering the rods, or locating one pair of rods nearer the center line at one end of the device and the other pair of rods nearer the center line at the other end of the device, or segmenting the rods axially and applying different DC offsets to successive segments. The disclosure and drawings of said application are hereby incorporated by reference into this application.

Figure 2:
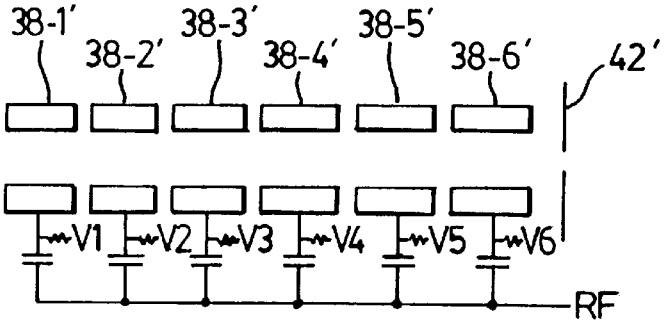
FIG. 2 is a diagrammatic view of a modification of a part of the apparatus of FIG. 1.

One typical electrode geometry which may be used is that depicted in FIG. 2, where primed reference numerals indicate parts corresponding to those of FIG. 1. Here, the rods 38' are divided into segments 38-1' to 38-6', with DC offsets V1 to V6 which increase in negative value applied to successive segments from 38-1' to 38-6'. This arrangement will provide an axial field as described in said application. Such an arrangement will strongly concentrate ions in the volume near the exit lens 42' and will increase the coupling of axial and radial ion motion.

If desired, the axial field can be oscillated as described in the above mentioned copending application. Such oscillation may enhance axial ejection of ions trapped in the volume near the exit lens 42. It can also be used for ion dissociation as described in said application, by oscillating the ion population trapped in the rod structure about their equilibrium positions.

The system described can be considered as being an open-ended three-dimensional ion trap, where the open end is an integrated high efficiency ion injection device (supplied by ion source 14). The ions in the vicinity of the exit lens 42 experience a three-dimensional trapping field comprised of radial and axial components. Radially the ions are contained by the main RF field applied to the linear rods 38. Axially the ions are contained at the exit end of the device by the DC potential on the exit lens 42, and are contained at the entrance end of the device by the potential gradient from the applied axial field (or from the skimmer 32). The ions are also to some extent contained in the trapping region or volume 54 by the field created by the build-up of charge density upstream of that region. It will therefore be appreciated that the actual trapping volume 54 is variable along the axial or Z direction.

If desired, the RF on the rods 38 can be scanned to eject ions mass dependently, while keeping a DC potential barrier on end lens 42 but with no AC field on end lens 42, no modulation of the DC offset on rods 38, and no auxiliary AC field on rods 38. In that case, ions in the fringing fields at the downstream ends of rods 38 will leave axially mass dependently and be detected, but most of the ions between rods 38 (those in region 60) will leave radially and will be wasted. The wastage can be reduced by segmenting rods 38 as shown in FIG. 2, making the last set of segments 38-6' very short (e.g. less than 1 cm), and scanning the RF for ejection only on segments 38-6'. In this way, a higher proportion of the ions between rods 38-6' will be ejected axially mass dependently, for detection.

Often many of the ions from conventional ion sources are of little or no analytical utility. Examples of such ions are low mass solvent and cluster ions. These ions simply serve to increase the overall charge density within the ion trap at the expense of optimum performance. Various techniques may be used to eliminate such unwanted ions from the linear ion trap described. One such method is to operate the main RF voltage from power supply 50 at a level where the analytes of interest are stable within the rod structure 38, but the unwanted ions are unstable. For example if the unwanted ions are in the mass to charge range 10 to 100, and the ions of interest are in the mass to charge range 200 to 1,000, then the main RF voltage can be operated at 214 volts peak to peak.

Another method of eliminating unwanted ions from the ion trap is to apply an additional auxiliary AC voltage between opposite pairs of the rods 38, to resonantly eject the unwanted ions radially out of the rod set. This technique is well known, as mentioned. In the technique an auxiliary AC voltage, of magnitude equal to about 10% of the level of the main RF voltage and of much lower frequency, is typically applied between opposite pairs of rods. The auxiliary AC voltage, of appropriate amplitude and frequency, may be scanned to resonantly eject unwanted ions radially.

The use of resonant ejection to eject ions is disclosed in Langmuir U.S. Pat. No. 3,334,225, in Syka et al. U.S. Pat. No. Re 34,000, and in Kelley U.S. Pat. No. 5,381,007 and is also disclosed in Douglas U.S. Pat. No. 5,179,278 assigned to the assignee of this application.

Another technique for removing unwanted ions is to apply low voltage DC to opposite pairs of rods to make the rods 38 act as a low resolution mass spectrometer. The magnitude of the DC applied will be such that the combination of AC and DC ejects ions only in the low mass range which is not of interest.

Finally, unwanted ions can be eliminated from rods 38 by the application of a filtered noise field to the rods, such that only ions of interest are stable within the rod structure and can be stored. The use of such a filtered noise field is disclosed in Langmuir U.S. Pat. No. 3,334,225 issued Aug. 1, 1967 and in Kelley U.S. Pat. No. 5,381,007 issued Jan. 10, 1995.

Figure 3:
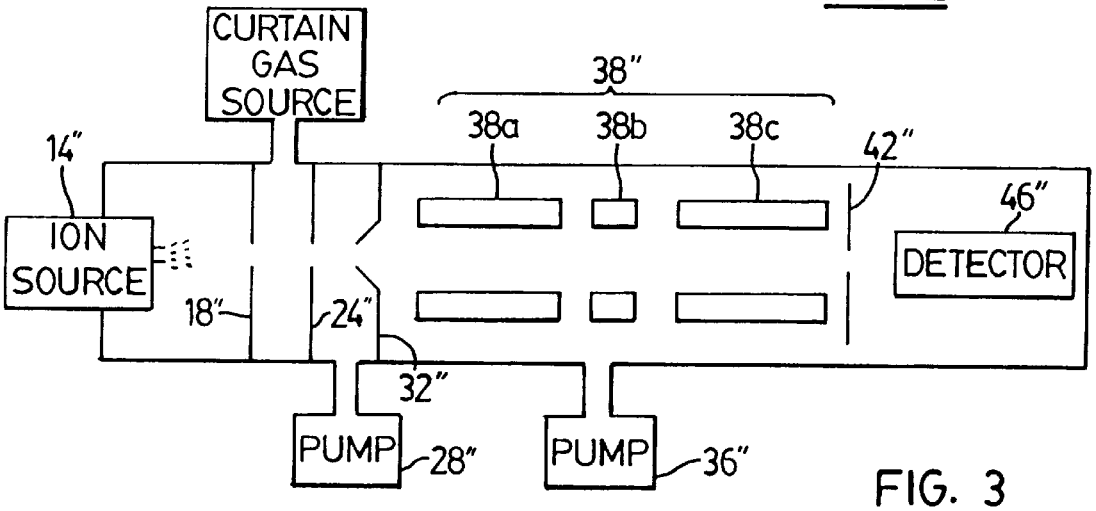
FIG. 3 is a diagrammatic view of a further modification of the apparatus of FIG. 1.

One of the disadvantages of most ion traps is that as mentioned, they cannot accept additional ions while performing an analysis. When using continuous ion sources this leads to reduced duty cycles and decrease overall sensitivity, since many or in fact most of the ions generated by the source are not analyzed and are wasted. Douglas U.S. Pat. No. 5,179,278 teaches that a multipole inlet system can reduce these problems by accepting and storing ions from the ion source while the ion trap is performing an analysis. This can dramatically enhance the overall system sensitivity by increasing duty cycle. FIG. 3 illustrates a device which uses these principles.

In the FIG. 3 device, in which double primed reference numerals indicate parts corresponding to those of FIG. 1, the rods 38" have been divided into three sets of rods 38*a*, 38*b* and 38*c*. Rods 38*a* are used to pre-trap ions from the continuous ion source 14". The rods 38*b* are used as an RF rod mirror that can reflect or transmit ions, by changing the DC offset of rods 38*b*. The rods 38*c* and lens 42" serve as the open-ended ion trap previously described, for analysis of ions which are injected into rods 38*c* through the rods 38*b*.

In operation, the RF and DC voltages on rod set 38*a* are set to accept ions within a mass range of interest, while the AC and DC voltages on rod set 38*b* are set to reflect ions, so that a population of ions accumulates in rod set 38*a*. (The operation is exactly as described for rod set 44 in U.S. Pat. No. 5,179,278.) After a predetermined time, the voltages on rod set 38*b* are changed to allow passage of the accumulated ions in rod set 38*a* through rod set 38*b* to rod set 38*c*. The RF voltage and DC offset voltage applied to rod set 38*c*, and the AC and DC voltages applied to lens 42", are set such that rod set 38*c* operates as an ion trap with axial ejection as described in connection with FIG. 1. Thus, ions are axially ejected in a mass dependent manner from rod set 38*c*, as previously described, for detection in detector 46".

While mass analysis is being performed in rod set 38*c*, the voltages on rod set 38*b* return to the ion reflection mode and further ions from the source 14" are stored in rod set 38*a*. An advantage of this configuration is that while ions are being analyzed in rod set 38*c*, ions from the continuous source are accumulated for subsequent analysis in the pre-trapping region, i.e. rod set 38*a*, and are not lost. As U.S. Pat. No. 5,179,278 teaches, proper optimization of the time to collect sufficient ions to fill the analysis region of the device, the time to empty the pre-trap region, and the time to perform analysis can result in very high duty cycles, and thus high overall sensitivity. Of course even in the FIG. 1 arrangement, ions are collected in region 60 of rods 38 while ions from the extraction region 54 are being ejected, so that some ions can be collected while the ion trap constituted by rods 38 and lens 42 is scanning out ions. However the FIG. 3 version allows storage of more ions since a larger volume can be used. In addition, some DC can conveniently be applied between the pairs of rods of rod set 38*a* to eliminate unwanted ions, thus reducing space charge effects in rod set 38*c*.

Figure 4:
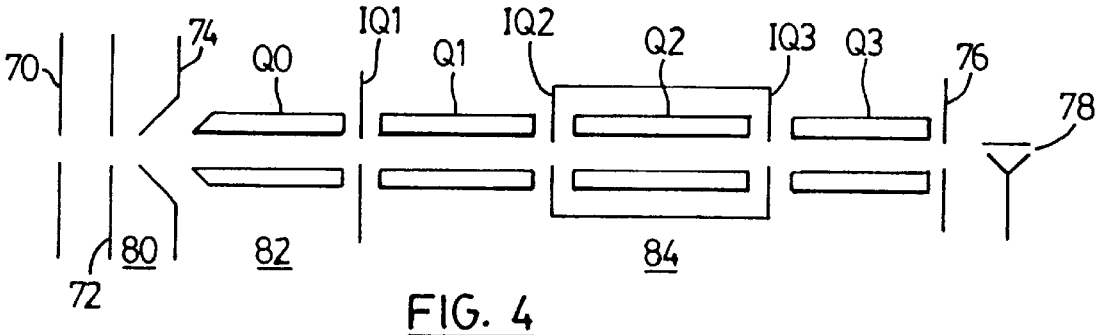
FIG. 4 is a diagrammatic view of another modification of the FIG. 1 apparatus.

By way of example, 0.1 $\mu$M (micro moles) of reserpine (having mass to charge ratio 609) was introduced using the well known ion spray source (not shown) into a conventional mass spectrometer model API 300 produced by Sciex Division of MDS Inc. of Concord, Ontario, Canada. A simplified diagrammatic view of the model API 300 ion optical path is shown in FIG. 4, where the gas curtain entrance plate is indicated at 70, the gas curtain exit plate is indicated at 72, the skimmer plate is shown at 74, and four sets of rods are indicated as Q0, Q1, Q2 and Q3, with orifice plates IQ1 between rod sets Q0 and Q1, IQ2 between Q2 and Q3, and IQ3 between Q2 and Q3. The exit lens is indicated at 76 and the detector (a channel electron multiplier) is indicated at 78.

In the FIG. 4 example, the pressures were 2.2 Torr in chamber 80, 8 milli-Torr in chamber 82 and $2\times10^{-5}$ Torr in the remainder of the vacuum chamber 84. The applied DC voltages were: ground at skimmer plate 80; −5 volts DC at Q0, −7 volts DC at IQ1, −10 volts at Q1, −20 volts at IQ2, −7 volts DC at Q2, −3 volts DC at IQ3 (which served as the equivalent of the exit lens 42); −15 volts DC on Q3, and 0 volts on the final exit plate 76. All resolving DC voltages were removed from the quadrupoles.

Q2, which was normally a collision cell, was configured to trap ions and had a cell pressure of $1\times10^{-3}$ Torr. In addition, an auxiliary AC voltage was applied to the exit lens IQ3. The auxiliary AC power supply could produce 100 volts peak to peak, at frequency one-ninth that of the main RF frequency, and was synchronized and phase locked to the phase and frequency of the main RF frequency. (The main RF frequency was 816 kHz so that of the auxiliary AC voltage was 90.67 kHz.) The auxiliary AC voltage was held at 47 volts peak to peak, its frequency was held constant at 90.67 kHz for the experiment, and the RF voltage applied to the Q2 rods was scanned to obtain a mass spectrum. Although scanning the amplitude of RF voltage changes the trapping conditions and could eject very low mass ions, the q of the device is so low under the conditions described that ions of interest trapped in the rod set Q2 are not normally ejected (unless the experimenter is interested in extremely low mass ions).

The sequence of events in the experiment was:

(a) A short pulse of ions was allowed to pass from Q0 into Q2 (Q1 performed no function except as an ion pipe during this experiment) by changing the DC lens voltage on IQ1 from +20 volts (which stopped ions) to −7 volts (for ion transmission).

(b) Ions that were trapped in Q2 were then scanned out axially by ramping the RF applied to the Q2 rods, typically from 924 volts peak to peak to 960 volts peak to peak.

(c) Q2 was then emptied of any residual ions by reducing the RF applied to its rods to a very low voltage, typically 20 volts peak to peak.

(d) The sequence was then repeated.

Figure 5:
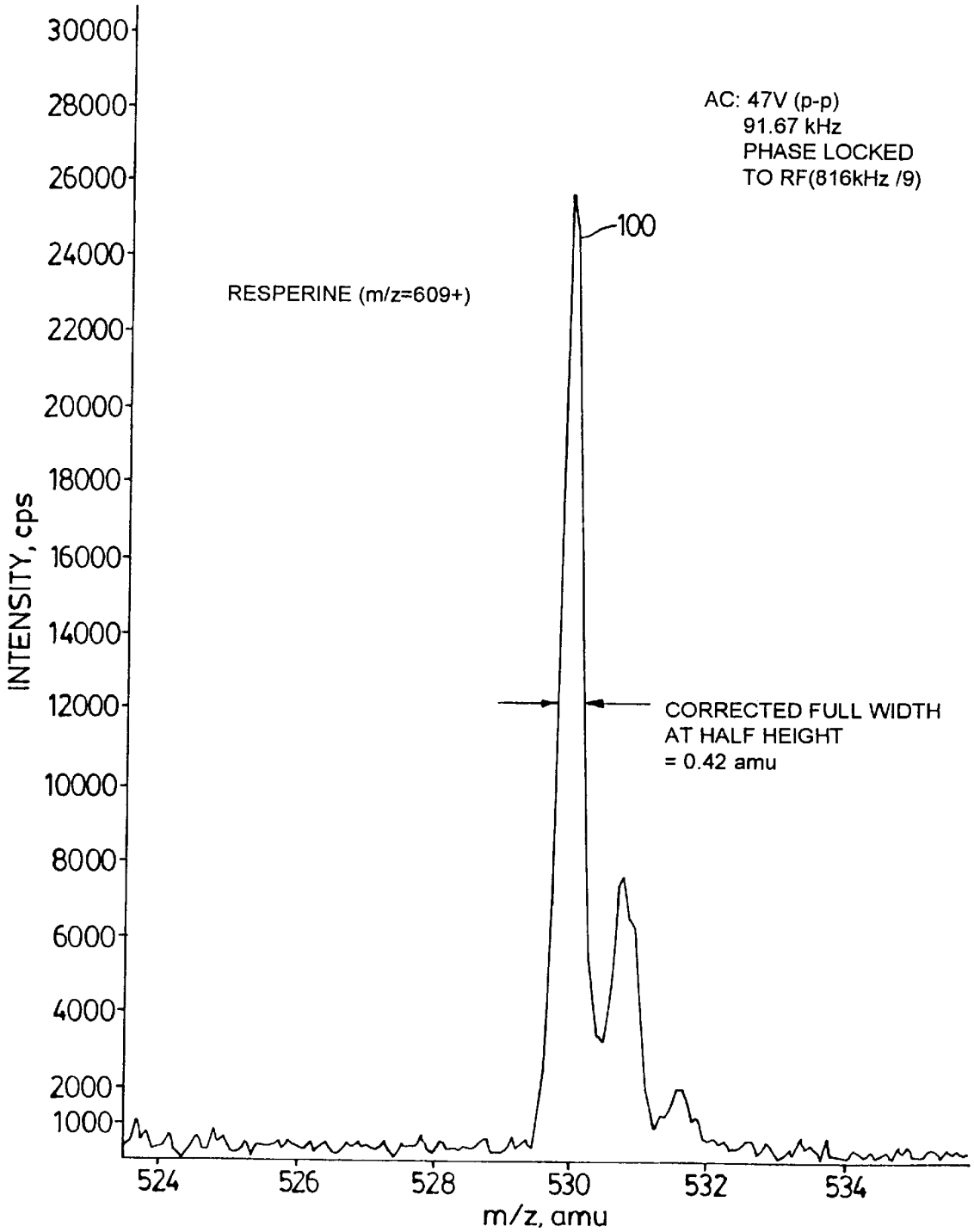
FIG. 5 is a graph showing results obtained with the apparatus of FIG. 4.

A typical spectrum produced using this technique is shown in FIG. 5, which shows a peak 100 at mass 529.929. Since the spectrum was not mass calibrated, the reported peak of 529.929 was incorrect; the true mass was 609.

It will be seen that the peak width at half height, corrected manually for the mass calibration offset, is 0.42 AMU. This yields an M/ΔM resolution value at M/Z609 of about 1450, which is a very high resolution. In the example shown, good resolution was best obtained by scanning slowly, at a scan speed in this example of 78 AMU per second. However with optimization, higher scan rates are expected to be achieved.

In another experiment performed with the FIG. 4 apparatus, fragmentation was performed under the following conditions:

(a) Two volts trapping DC were applied to lens IQ3.

(b) 62 volts (peak to peak) AC at 90.67 kHz were applied to lens IQ3.

(c) Q1 was set to a resolving mode (RF and DC were applied) to allow only transmission of a selected parent ion, namely renin substrate tetra decapeptide $(M+3H)^{3+}$ at m/z 587.

(d) Q3 was set to RF only (the resolving DC was removed).

(e) Q2 was pressurized with $1\times10^{-3}$ Torr helium.

The experimental steps were:

1. A pulse of m/z 587 ions was allowed to pass from Q0 to Q2 by changing the voltage on lens IQ1 from 20 volts to −7 volts.
2. Ions within Q2 were excited by setting the RF rod voltage to 897.8 volts peak to peak for 50 ms. This was an excitation step. Ions in Q2 which were in resonance with the applied AC field (on IQ3) were excited (absorbed power) and, because of their increased kinetic energy, were either ejected from the trap or fragmented due to collisions with the background gas.
3. Immediately after the 50 ms excitation step, ions in Q2 were scanned out mass dependently axially by scanning the Q2 RF rod voltage from 800 volts peak to peak to 1,422 volts peak to peak. This step simply took a "snapshot" of the ions that had remained in the trap after the excitation step.

Figure 6:
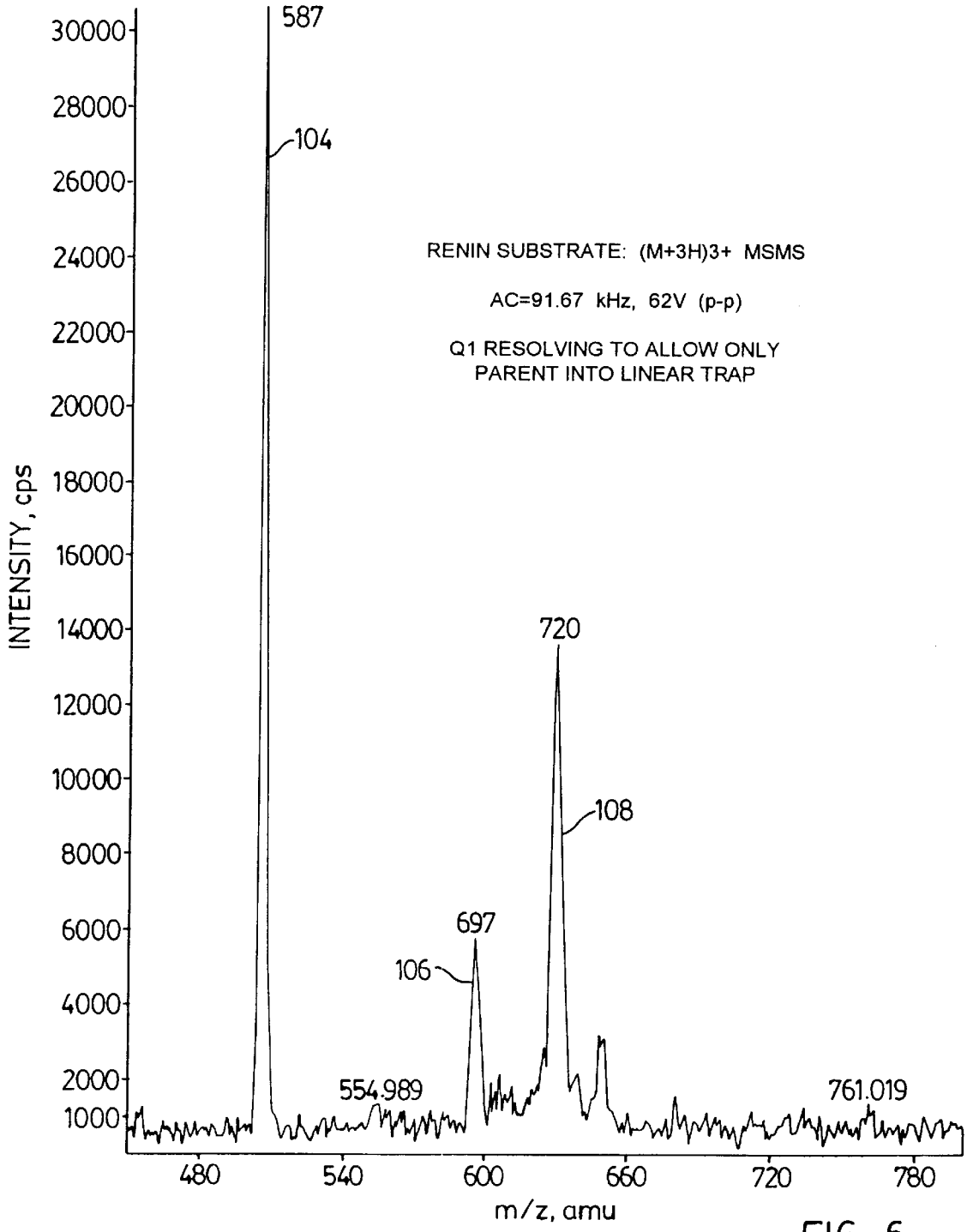
FIG. 6 is a graph showing further results obtained with the FIG. 4 apparatus.

The observed ions are shown at peaks 104, 106, 108 in FIG. 6. Again the mass spectrum was not calibrated and is shown corrected. Peak 108 is the parent ion at m/z 587 (triply charged), while the fragment ions m/z 697 and m/z 720 are shown at 106, 108 (they have higher m/z ratios because they are only doubly charged).

Thus, it will be seen that collisional fragmentation can readily be performed in the linear trap described, and the fragment ions can be scanned axially in a mass dependent manner for detection and analysis.

In yet another experiment performed with the FIG. 4 apparatus, a mass spectrum was provided under the following conditions. No auxiliary AC voltage was applied to the exit lens IQ3, but instead only the standard DC barrier field was provided at lens IQ3. In this situation, mass selective ejection from rod set Q2 in the axial direction will still occur, through the coupling of the radial and axial degrees of freedom of the trapped ions by the fringing fields in the vicinity of the exit lens IQ3. Without an auxiliary AC voltage applied to lens IQ3, ions are ejected from Q2 at a q value corresponding to the stability limit of approximately 0.906.

In this method of operation, ions are trapped in rod set Q2 by the applied DC field on the exit lens IQ3, and then the RF voltage on the rods of rod set Q2 is increased such that the q of the trapped ions exceeds approximately 0.906. This leads to radial ejection in regions of rod set Q2 where the fringing fields are negligible. The radially ejected ions will travel toward all four rods and will be lost. However in the vicinity of the exit lens IQ3, where there is significant radial/axial coupling, axial ejection occurs. When q is greater than about 0.906, the rod set Q2 will be emptied of all of the analyte ion through the combination of radial and axial ejection. In addition, when the q value is greater than about 0.906, subsequent ions from the ion source (passing through Q0, Q1 and Q2) are no longer stable in the rod set Q2 and cannot be accumulated.

The fringing fields in the vicinity of exit lens IQ3, created by the interaction of the DC barrier field on lens IQ3 and the RF field on rod set Q2, extend only a short distance into rod set Q2 in the vicinity of the exit lens IQ3. As mentioned, the distance of such penetration is not presently known and so far as the applicant is aware, no mathematical model for determining the depth of penetration presently exists. The depth of penetration will however increase as the exit lens IQ3 is brought closer to the rod ends of Q2. Since the rod set Q2 in FIG. 4 was 200 mm long, therefore when the RF on the rod set Q3 is ramped, most of the ions are lost to radial ejection and only a relatively small proportion are axially ejected. However because the duty cycle is so much higher than with conventional instruments, it is found that the signal level achieved is of the same order as or better than those achieved with conventional instruments. (This is because, as mentioned, ions are being accumulated and trapped in Q0 while Q2 is performing its analysis.) If desired, Q2 may be made shorter, so as to lose fewer ions to radial ejection, while still keeping Q2 long enough to avoid undesirable effects such as space charge effects.

In addition, it is found that when no auxiliary AC voltage is applied to the end lens IQ3, but instead when the fringing fields are produced simply by the interaction of the DC barrier field on the end lens with the RF applied to the rod set Q2 (or with an auxiliary AC voltage applied to rod set Q2), then fewer parameters need to be manipulated and useful signal can more readily be obtained.

By way of example, a 1 $\mu$M solution of reserpine with mass to charge ratio of 609 was introduced into the FIG. 4 instrument. The relevant voltages and pressures were as follows. The pressure in chamber 82 was 8 milli-Torr, and in the remainder of the vacuum chamber 84 was $2\times10^{-5}$ Torr. The applied DC voltages were: ground at skimmer plate 74, −5 volts DC at Q0, −10 volts DC at IQ1, −6.5 volts DC at Q1, −15 volts DC at IQ2, −20 volts DC at Q2, −14 volts DC at IQ3, −20 volts DC at Q3, and 0 volts on the final exit plate 76. All resolving DC voltages were removed from the quadrupoles.

The standard collision cell Q2 was configured to trap ions and had a pressure of $1\times10^{-3}$ Torr of helium. As mentioned, no auxiliary AC voltage was applied to the exit lens IQ3.

The sequence of events in the experiment was:

(a) A short pulse of ions was allowed to pass from Q0 into Q2 by changing the DC lens voltage on lens IQ1 from +20 volts to −7 volts.

(b) The ions trapped in collision cell Q2 were then scanned out axially by ramping the RF applied to the Q2 rods, typically from 1,350 volts peak to peak to 1,540 volts peak to peak.

(c) The sequence was then repeated.

Figure 9:
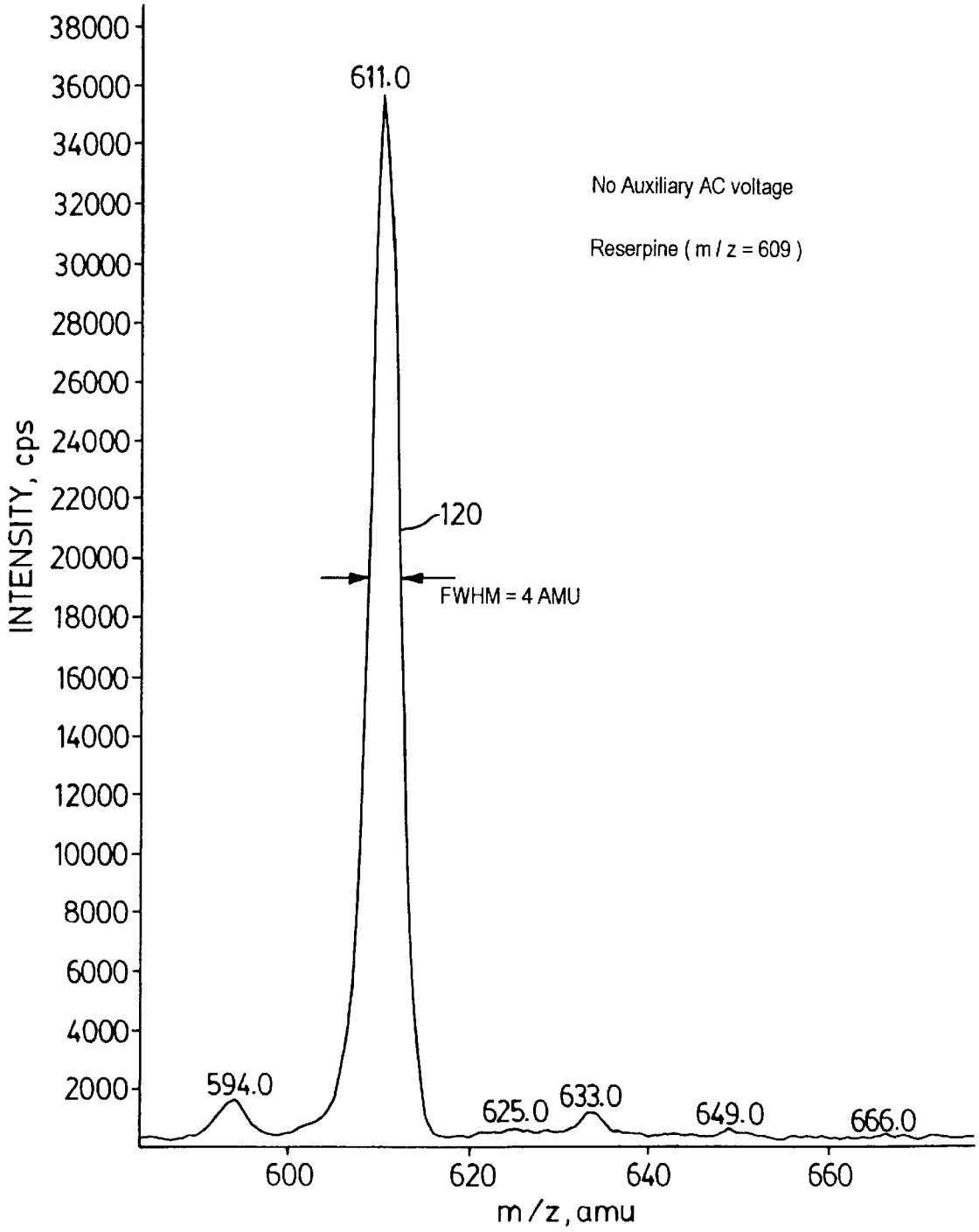
FIG. 9 is a graph showing still further results obtained with the FIG. 4 apparatus.

A typical spectrum obtained with the technique described above is displayed in FIG. 9, which shows the reserpine parent ion at mass 611, indicated at reference 120. The instrument was slightly out of calibration, causing the correct mass of 609 to be reported as 611. Although the peak width at half height is broad (approximately 4 AMU), the configuration described is easy to optimize, can be scanned rapidly (e.g. up to or more than about 5,000 AMU per second) and provides sufficient resolution for many applications. In addition it is believed that the mass resolution can be enhanced.

Instead of ramping the RF field applied to rod set Q2, an auxiliary dipole AC field may be applied to rod set Q2, typically across one pair of rods. Typically the dipole field is set at a low level, e.g. 1 volt, to excite ions radially but not enough to eject them, and then the RF field is ramped in amplitude as before to mass dependently eject the ions from the rod set past the barrier field at the end lens. Alternatively, the RF can be fixed and the frequency of the dipole field can be ramped to excite the ions. Note that when a uniform dipole field is applied, ions are excited along the length of rod set Q2 but remain in the rod set, and under the influence of an axial DC field can be drifted toward the exit end of rod set Q2, where their radial movement is converted into axial movement by the fringing fields. Usually the axial motion created by this coupling will then be augmented by ramping the RF or dipole fields to mass dependently axially eject the ions past the barrier field of the end lens, for detection. An auxiliary quadrupole field may be used instead of the auxiliary dipole field, with similar results.

Figure 10:
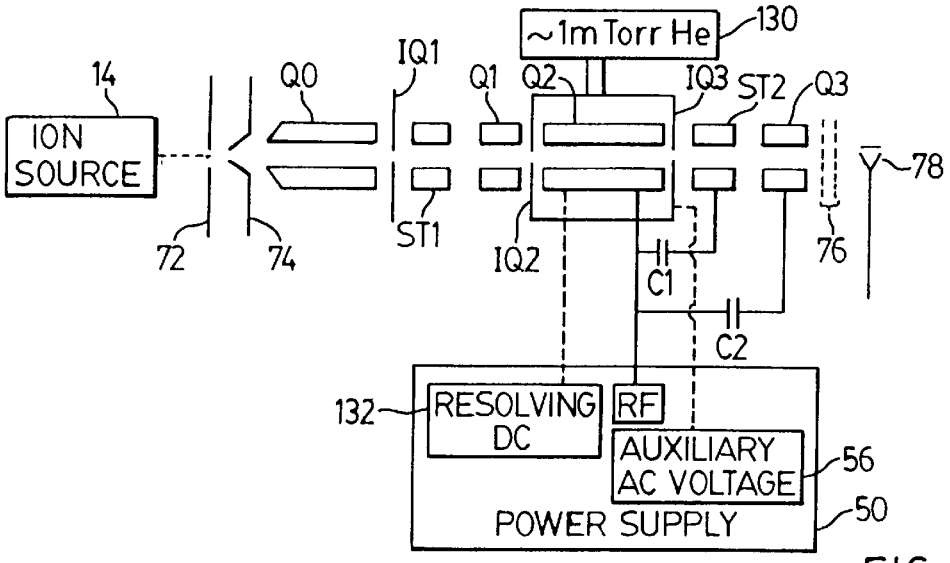
FIG. 10 is a diagrammatic view of a further modification of the FIG. 1 apparatus.

Reference is next made to FIG. 10, which shows a mass spectrometer system similar to that of FIG. 4, and in which corresponding reference numerals indicate corresponding parts. Only the differences from FIG. 4 will be described. The FIG. 10 mass spectrometer may be used as a high resolution axial ejection ion trap.

In FIG. 10, rods ST1 and ST2 ("ST" means "stubbies") are provided. These are simply short (typically one inch long) rods which form conventional Brubaker ion lenses. The rods of Q1 and Q3 are also short, typically one inch long.

A cooling gas source 130 supplies an inert gas, e.g. helium, to the Q2 rods at about 1 milli-Torr (as described but not shown in connection with FIG. 4).

In the conventional instrument shown in FIG. 4, RF from the main power supply 50 (not shown in FIG. 4) was connected to the Q3 rods, and RF for Q2 was capacitively coupled from the Q3 rods. In the FIG. 10 arrangement, RF from the power supply 50 (typically at 1 MHz) is connected directly to the Q2 rods, and RF on rods ST1 and Q3 is derived from the Q2 rods by capacitive coupling through capacitors C1, C2. This allows the RF amplitude on the Q2 rods to be made relatively high (higher in amplitude than that on the Q3 rods).

In operation, rods Q0, ST1, Q1, ST2 and Q3 are all operated in an RF-only mode, i.e. in an "ion pipe" or ion transmission mode. The pressure in ST1, Q1, ST2 and Q3 is typically about $3\times10^{-5}$ Torr.

Lens IQ3 is made slightly repulsive, e.g. by about 2 volts, with respect to the rod offset on Q2 (as before).

The FIG. 10 arrangement is preferably operated to excite trapped ions in Q2 with an auxiliary AC frequency (from source 56) applied to IQ3 at twice the secular frequency of the trapped ions (or if desired at three times or more the secular frequency). It is found, for reasons that are not fully understood, that this provides increased resolution.

Figure 11:
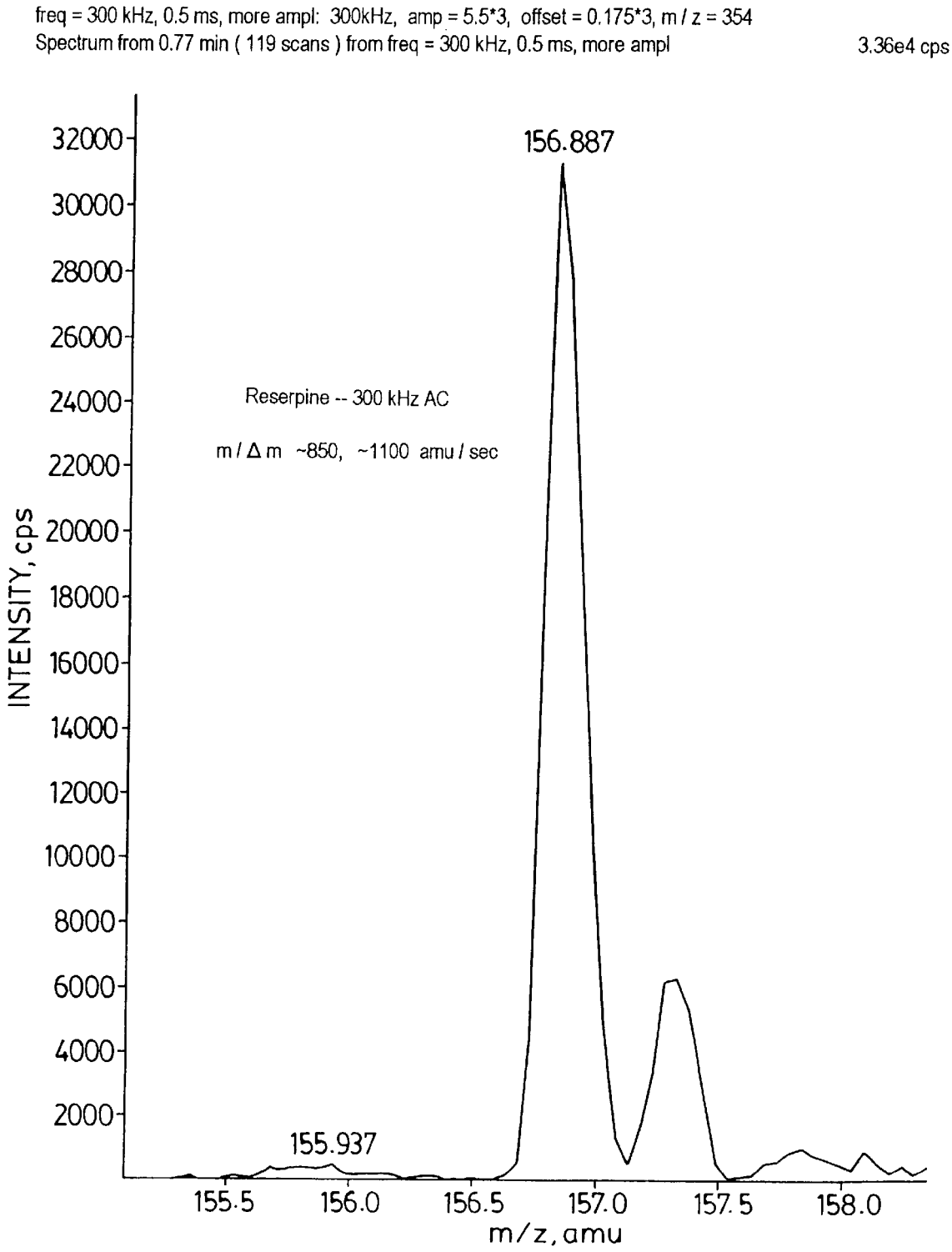
FIG. 11 shows a mass spectrum obtained with the FIG. 10 apparatus.

For example, reference is next made to FIG. 11, which shows a mass spectrum for reserpine, made using the FIG. 10 arrangement with auxiliary AC applied to IQ3 at 300 kHz. The auxiliary AC amplitude on IQ3 was 16.5 volts (peak to peak). It will be seen that the spectrum of FIG. 11 has improved resolution ($m/\Delta m$ approximately=850) as compared with that of FIG. 5.

Figure 12:
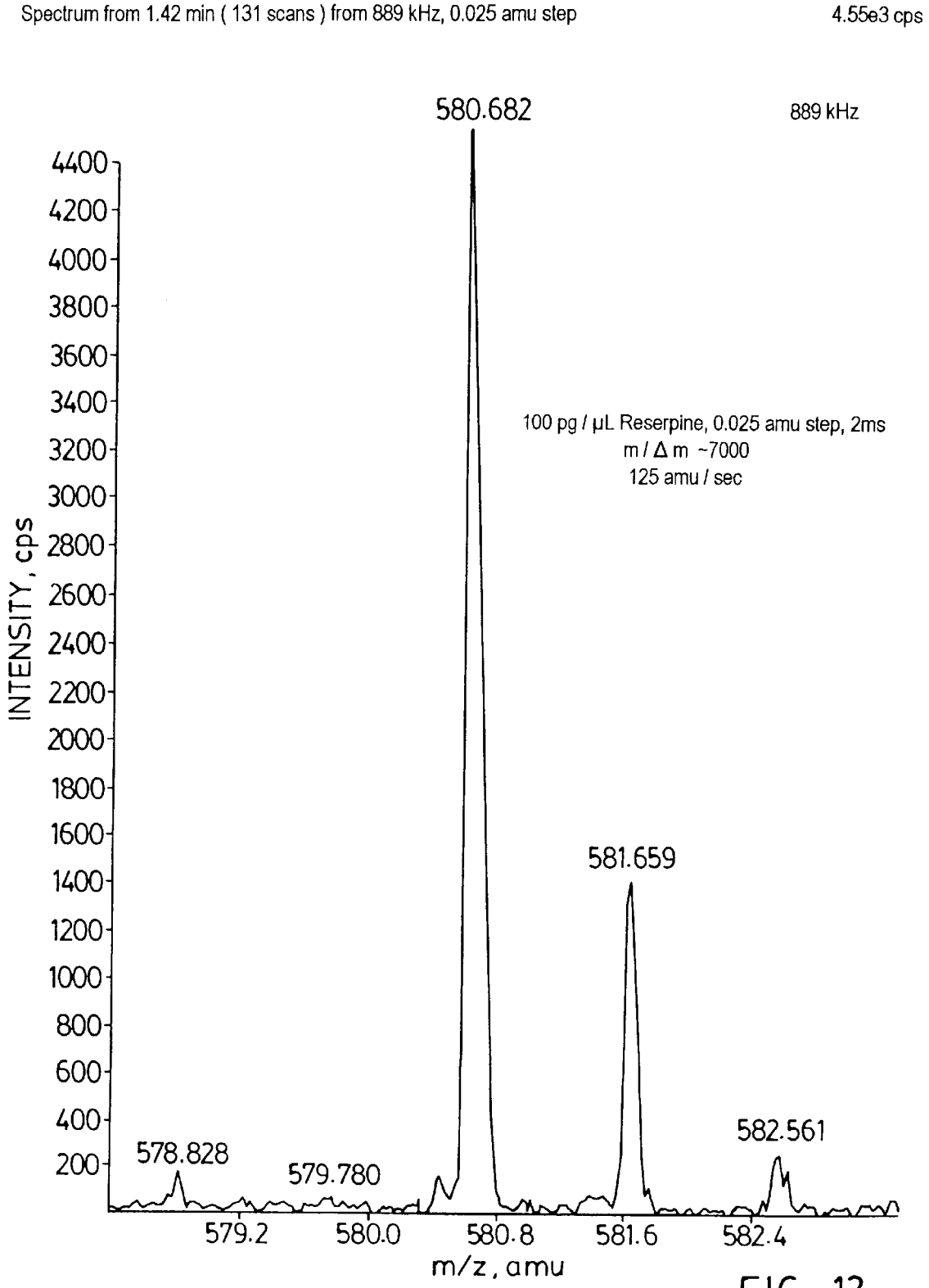
FIG. 12 shows another mass spectrum obtained with the FIG. 10 apparatus.

Reference is next made to FIG. 12, which shows another reserpine spectrum made from the FIG. 10 arrangement, but with the auxiliary AC frequency applied to IQ3 now at 889 kHz (again twice the secular frequency at the q in question for the ions being detected). In addition, a small amount of resolving DC (2.0 volts) was applied to the Q2 rods from DC source 132 (FIG. 10) in power supply 50. It will be seen that the resolution $m/\Delta m$ was vastly increased and was now 7,000, measured at the 50% level. The three peaks shown in FIG. 12 are the singly charged reserpine isotopes with one amu spacing. For the FIG. 12 spectrum, the AC amplitude applied to IQ3 was 16.5 volts (p—p).

Figure 13:
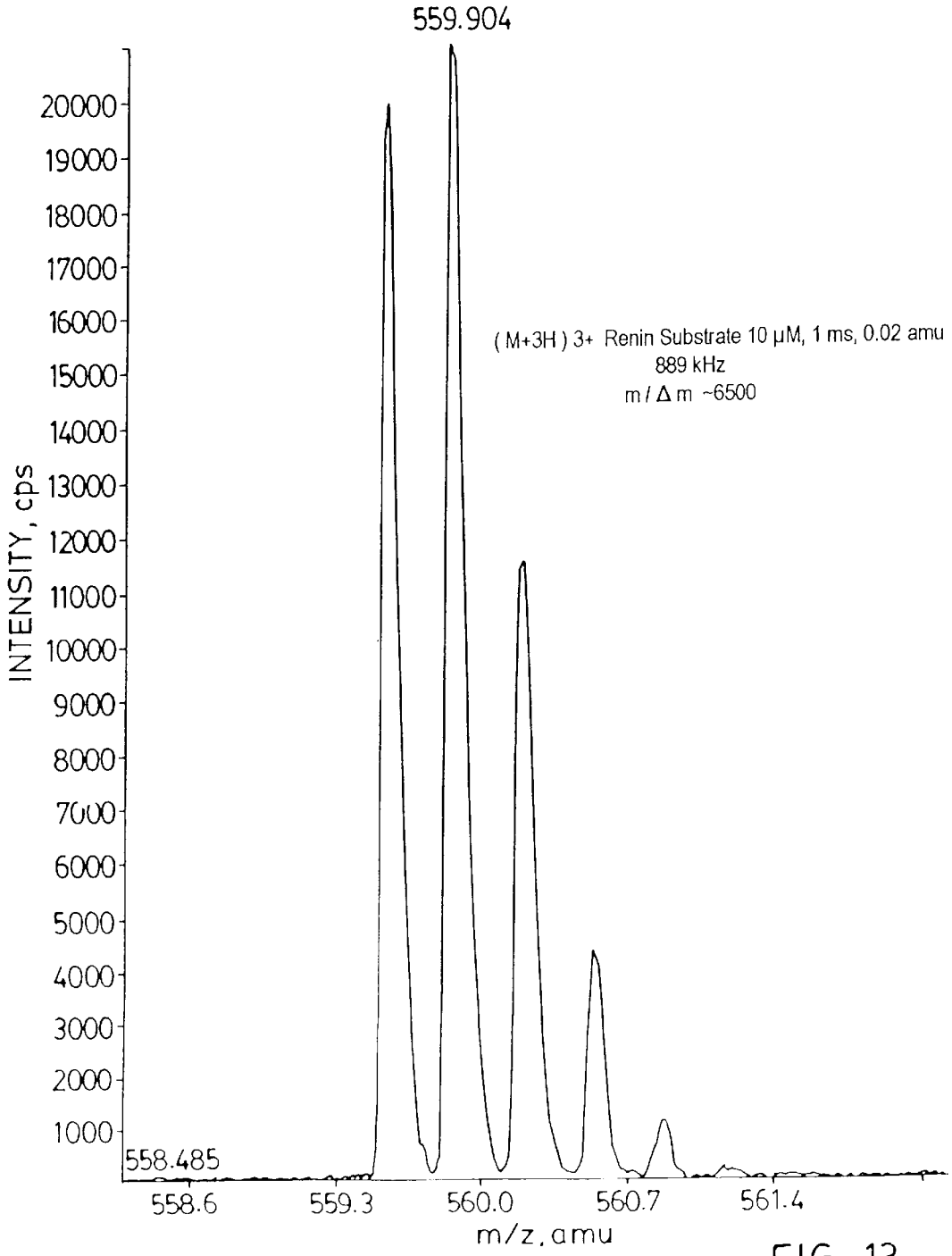
FIG. 13 shows a further mass spectrum obtained with the FIG. 10 apparatus.

FIG. 13 shows another spectrum obtained with the FIG. 10 arrangement, operating as described in connection with FIG. 12. However, in this case the substance being analyzed was renin substrate. As shown in FIG. 13, five triply charged peaks from the $(M+3H)^{3+}$ ion at m/z 587 (not mass calibrated) were displayed, all very close to each other, with a resolution $m/\Delta m$ of about 6500.

Figure 14:
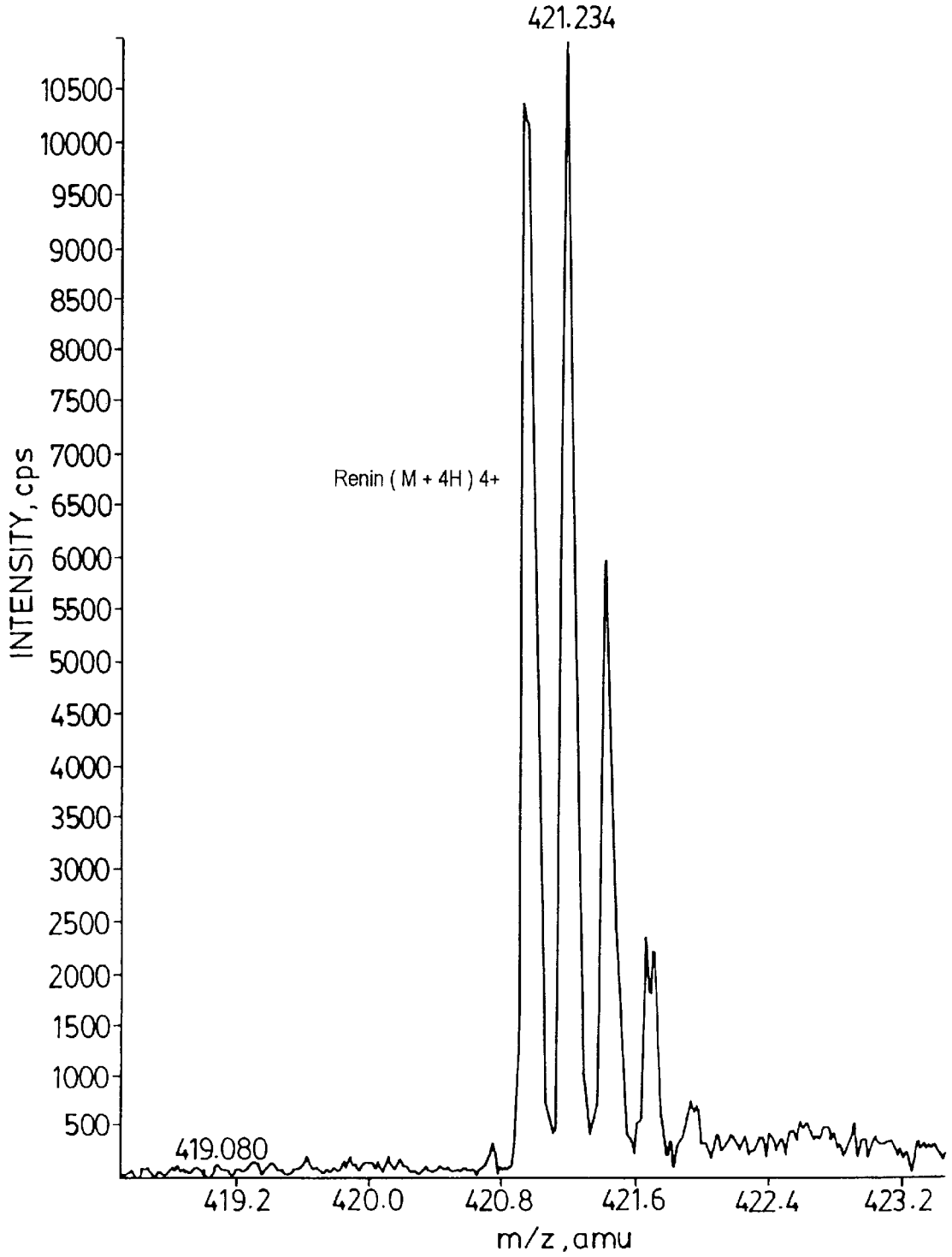
FIG. 14 shows yet another mass spectrum obtained with the FIG. 10 apparatus.

FIG. 14 shows another spectrum, for renin, using the FIG. 10 arrangement operated as described in connection with FIG. 13, i.e. with the auxiliary AC frequency applied to IQ3 at 889 kHz. The peaks shown in FIG. 14 represent quadruply charged ions from the $(M+4H)^{4+}$ ion at m/z 440 (not mass calibrated), and it will be seen that four peaks are displayed within about 1 m/z unit. The resolution approaches that of a time-of-flight mass spectrometer, but with much less cost and fewer operating difficulties, although the scanning time is slower than that of a time-of-flight instrument.

It is believed that the higher RF amplitude on Q2 creates a radial "well" for the ions, which well has a deeper well depth than previously. This causes the ions to be more tightly confined spatially in the radial dimension, thereby giving better dispersion of the secular frequencies, which helps achieve the higher resolution. It is not, however, fully understood why the auxiliary AC excitation at frequencies which are 2 times or more that of the ion's secular frequency leads to higher resolution.

Next, a modification of the FIG. 10 arrangement was used, in which no gas was added to the Q2 rods, so that the pressure in the volume defined by the rods was approximately the same as that in the other rods (e.g. $2\times10^{-5}$ Torr). Again, a small amount of resolving DC was applied to the rods of Q2 from DC source 132 in power supply 50 (in FIG. 10). It was found, as will be seen from the following spectra to be explained, that although this lack of cooling gas resulted in some loss of resolution, the resolution remained quite good (approximately unit resolution), but the sensitivity (i.e. the amount of ion signal produced) increased very substantially. In fact the ion signal obtained was 10 to 50 times higher without gas than with gas. In addition, it became possible to increase the scanning speed greatly while still achieving the higher sensitivity and reasonably good resolution.

It is believed that the higher sensitivity (increased ion signal) resulted because with gas in the Q2 rods, the trapped ions were collisionally cooled and forced into a relatively small volume in which space charge effects became noticeable. The space charge effects limited the number of ions which the trap constituted by rods Q2 could handle without spectral degradation. Without the cooling gas, the ions within the Q2 rods occupy a larger volume which can hold a larger number of ions before space charge effects become a problem.

In the mode of operation now contemplated for the FIG. 10 arrangement, ions are accumulated in Q0 (trapped by lens IQ1) while ions are being scanned out of Q2, just as described in connection with FIG. 3. As described in connection with FIG. 3, this results in a higher duty cycle, also increasing sensitivity.

Figure 15B:
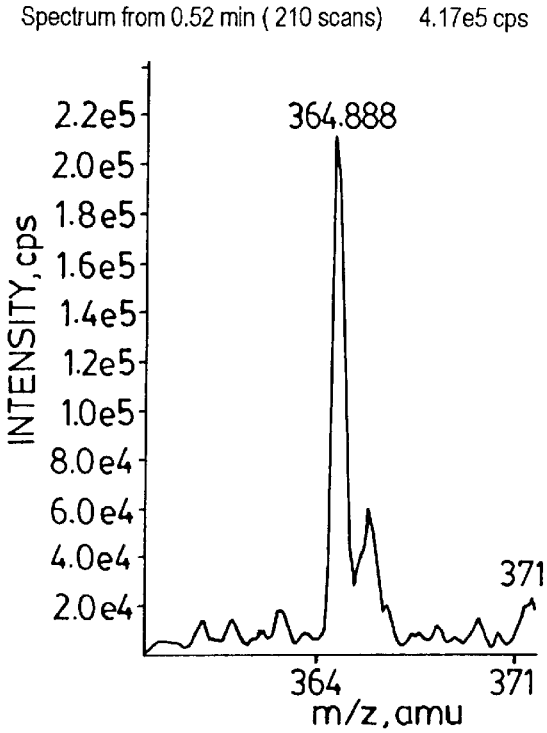
FIGS. 15*b* and 15*c* show enlarged portions of the FIG. 15*a* mass spectrum.
Figure 15C:
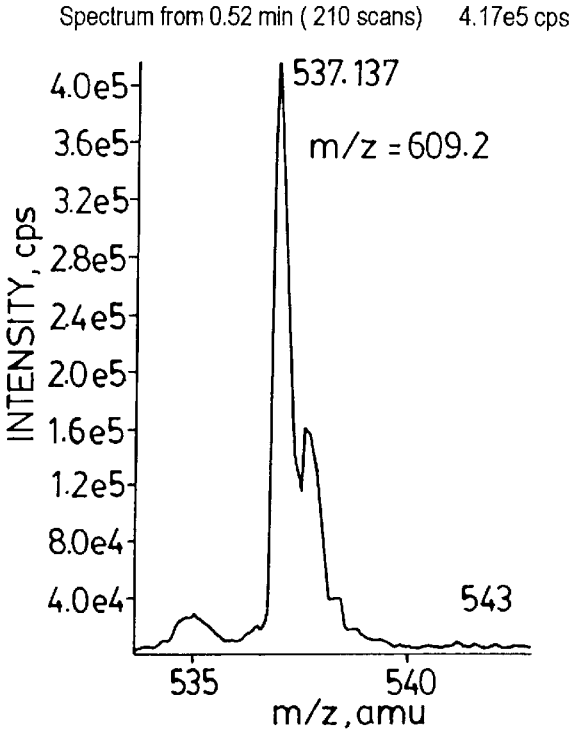
Figure 15A:
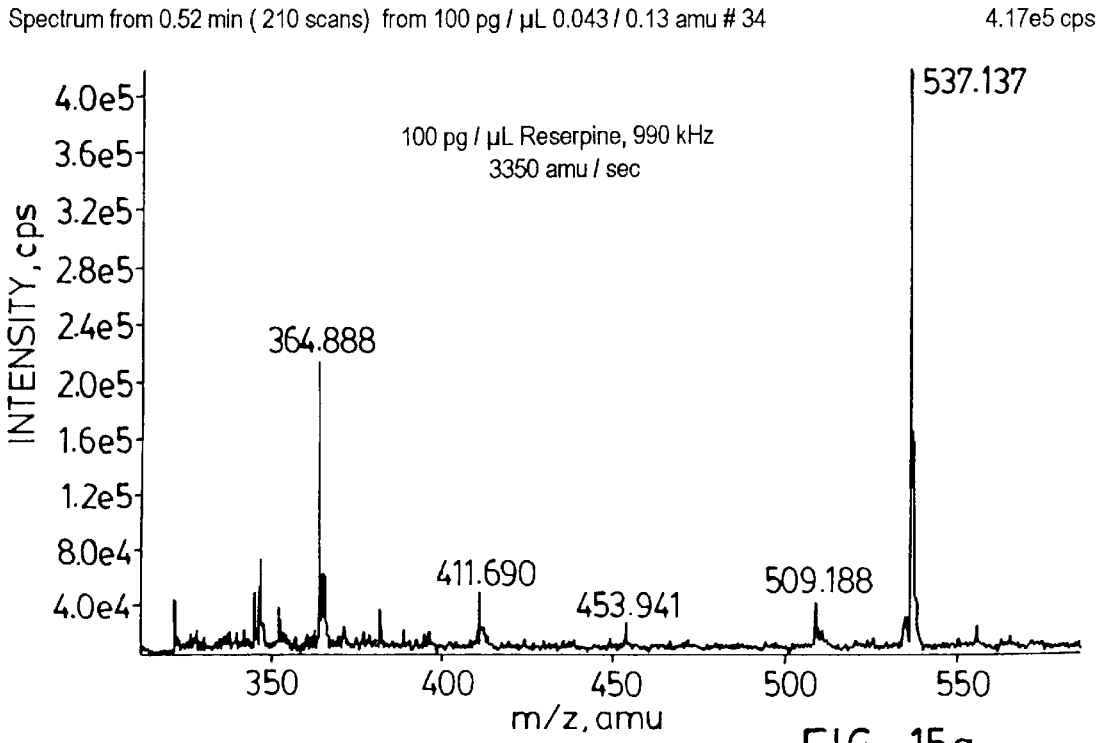
FIG. 15*a* shows a mass spectrum obtained using a modification of the FIG. 10 apparatus.

FIG. 15*a* shows a mass spectrum for reserpine made using the above-described mode of operation of the FIG. 10 arrangement (pretrapping in Q0, no cooling gas added to Q2, and a small amount of resolving DC on Q2). FIG. 15*b* shows a close-up of mass 364, and FIG. 15*c* shows a close-up of mass 537, from FIG. 15*a* (the spectrum was not calibrated so the masses shown are not the actual masses). It will be seen that the resolution is less than before, although still approximately unit resolution, but the intensity is 10 to 50 times higher than the previous reserpine spectra, as shown for example in FIG. 12. The reasons for the increased sensitivity were the reduction in space charge effects caused by the elimination of the cooling gas, the increased duty cycle from pre-trapping in Q0, and the use of a small amount of resolving DC. A further advantage of this mode of operation is that as indicated in FIG. 15, the scan rate was 3350 amu per second (which was the limit of the electronics used in the test), whereas with cooling gas in the Q2 rods, the scanning rate was much lower (typically 120 amu per second).

Figure 16A:
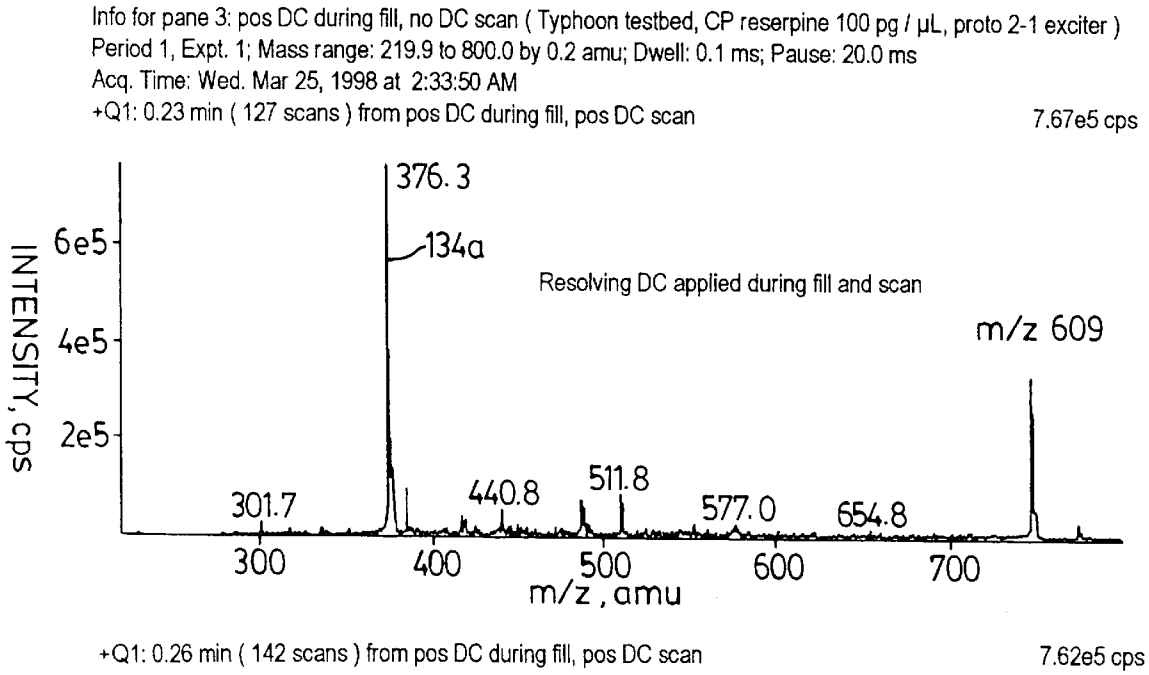
FIGS. 16*a*, 16*b*, 16*c* and 16*d* show mass spectra obtained during different modes of operation of a modification of the FIG. 10 apparatus.
Figure 16B:
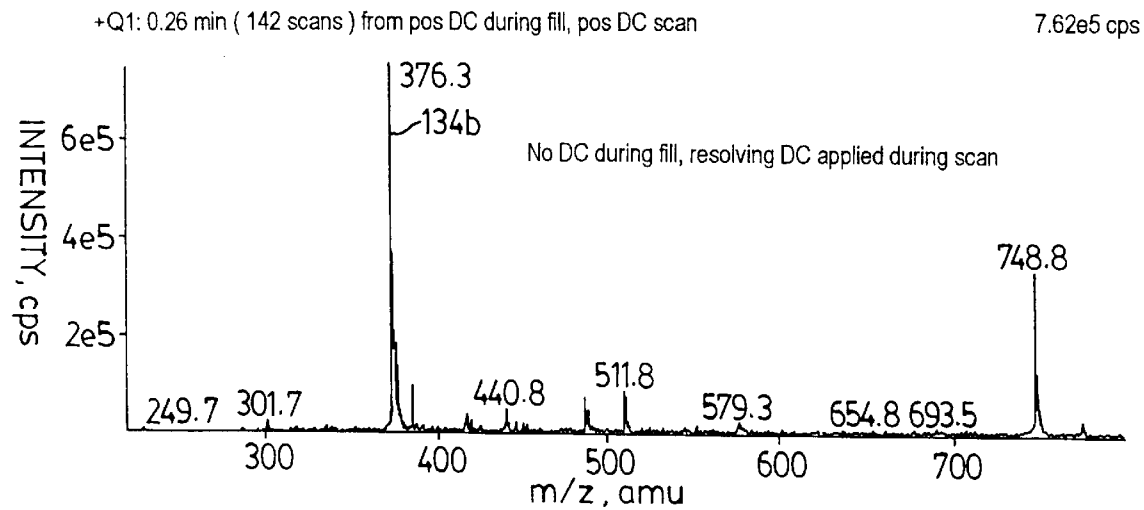

While it is not fully understood why the application of resolving DC during the scan improves the sensitivity, FIGS. 16*a* to FIG. 16*e* (which are spectra from 100 pg/$\mu$L of reserpine, not mass calibrated) show clearly the benefits of using resolving DC during the mass dependent axial ion scan from Q2. FIG. 16*a* shows the spectrum when resolving DC was applied during both fill of and scan from Q2, while FIG. 16*b* shows the spectrum when resolving DC was applied during the scan only from Q2. In both cases, the sensitivity for the peaks indicated at reference numerals 134*a*, 136*b* was very high (more than $6\times10^5$ ion counts per second).

Figure 16C:
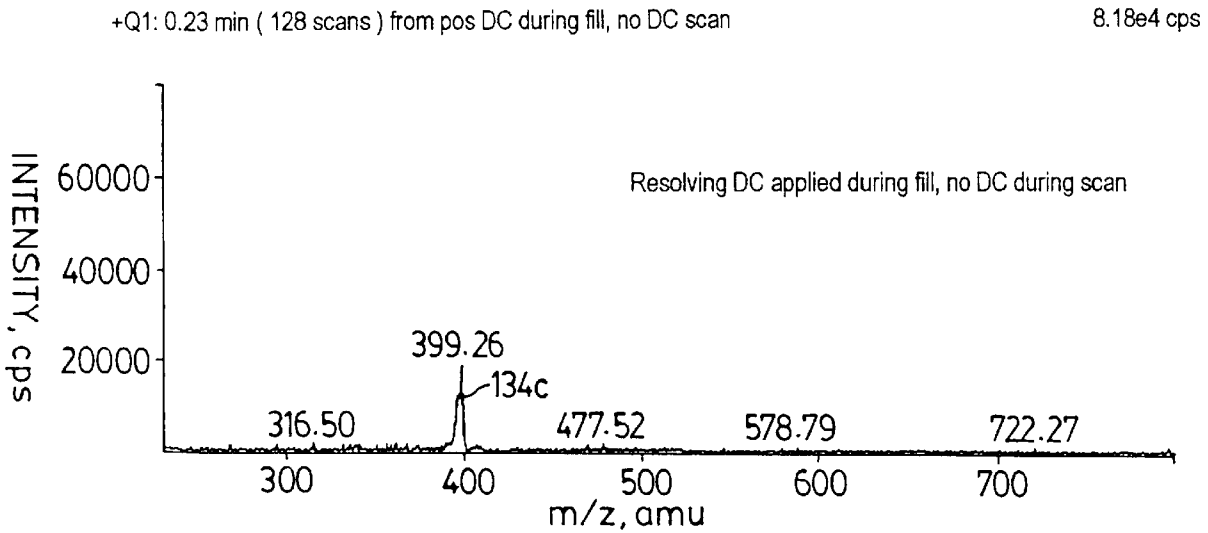
Figure 16D:
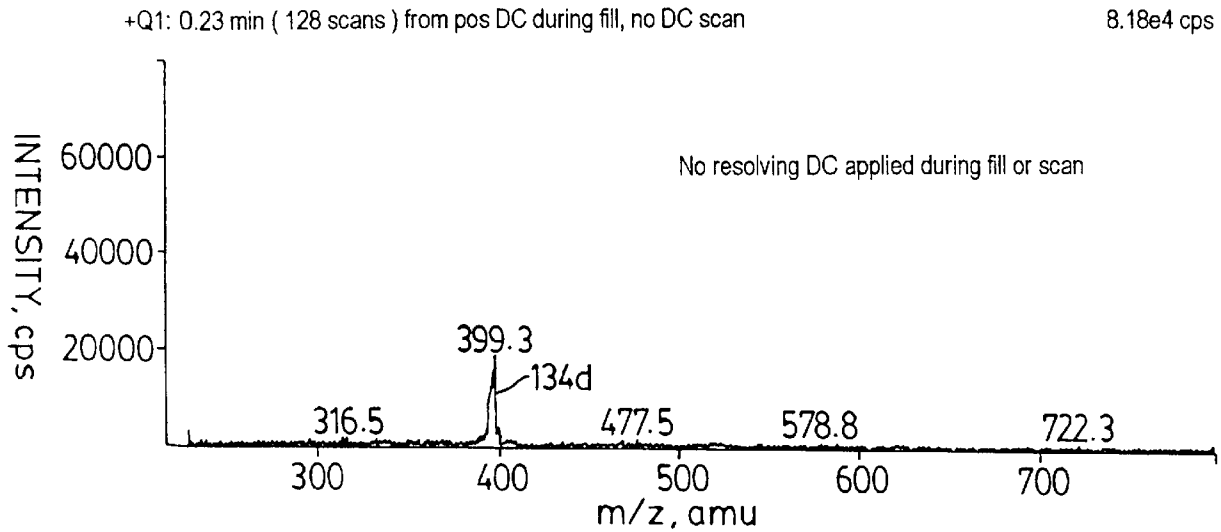

In contrast, as shown in FIG. 16*c*, where resolving DC was applied during the fill of the Q2 rods but not during the scan, and in FIG. 16*e* where no resolving DC was applied during the fill or the scan, the sensitivity for peaks 134*c*, 134*d* was much lower (about $2\times10^4$ counts per second) and the mass resolution was much poorer.

As mentioned, the reason why the application of resolving DC to the Q2 rods, during the mass dependent axial ion scan from Q2 through the repulsive barrier constituted by the voltage on lens IQ3, increases performance (sensivity and resolution) is not clearly understood. However, it has been determined that a wide range of resolving DC voltage amplitudes will suffice. For example, resolving DC voltages from as low as 0.5 volts up to 50 volts have been used, and all have generally the same beneficial effect.

Figure 17B:
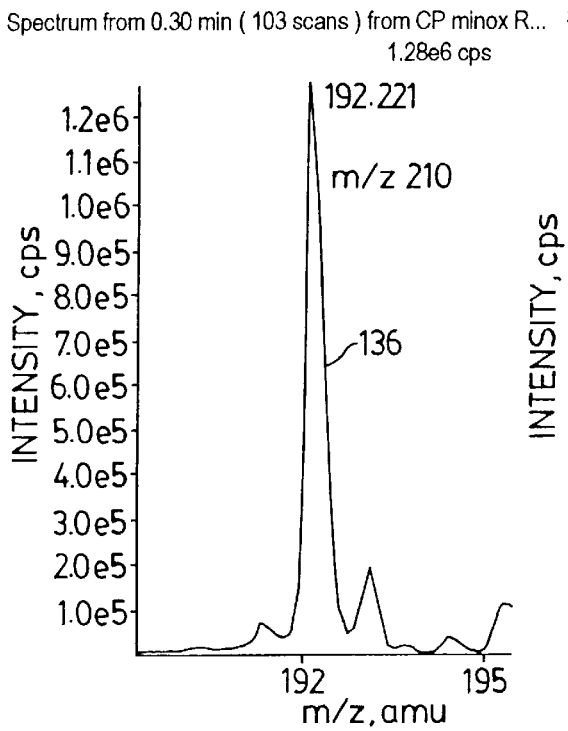
FIGS. 17*b* and 17*c* show enlarged portions of the FIG. 17*a* mass spectrum.
Figure 17C:
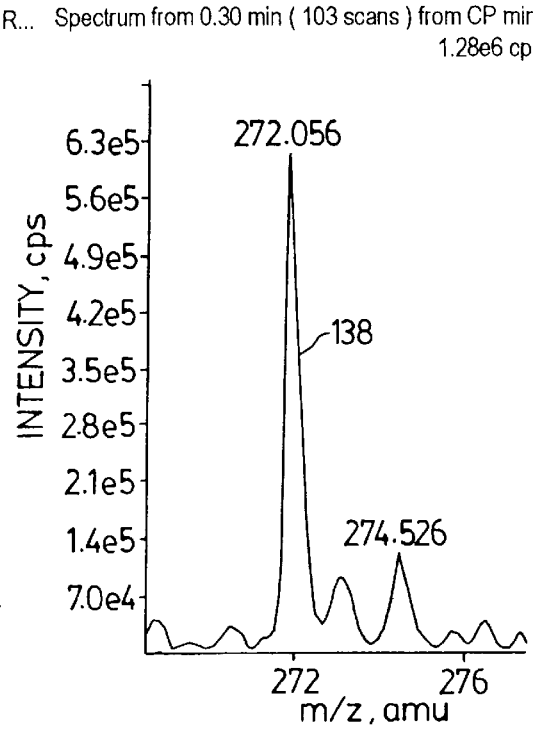
Figure 17A:
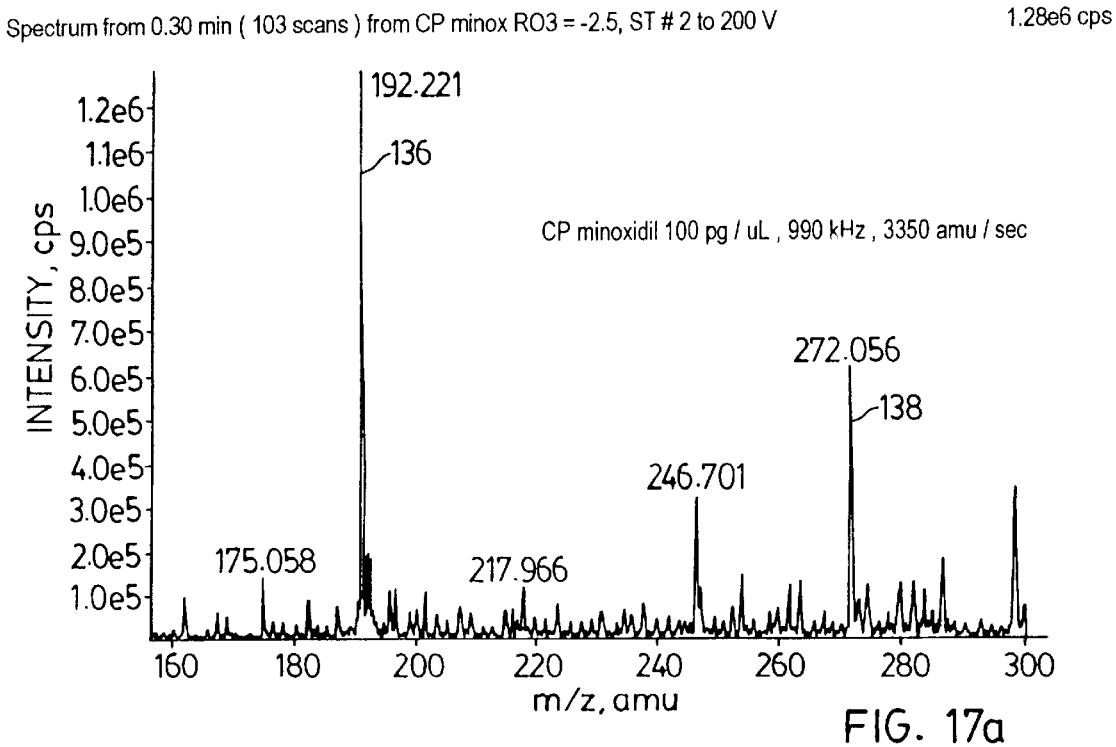
FIGS. 17*a* shows a further mass spectrum obtained using a modification of the FIG. 10 apparatus.

Another example is shown by the spectrum of FIG. 17*a*, for minoxidil, and by the spectra of FIG. 17*b* and 17*c* which show two peaks 136, 138 from the FIG. 17*a* spectrum. The FIGS. 17*a*, 17*b* and 17*c* spectra were made using the FIG. 10 apparatus in the mode just described, with no cooling gas added, and with pre-trapping in Q0, and with added resolving DC. Because the mass scale has not been calibrated, the feature reported at 192.221 amu is actually the minoxidil $(M+H)^+$ ion. Again, it will be seen that the sensitivity was very high (more than $6\times10^5$ counts per second for the smaller peak 138); the resolution was good (unit resolution or better), and the scan rate was 3350 amu per second, which was considered to be very high.

Figure 18:
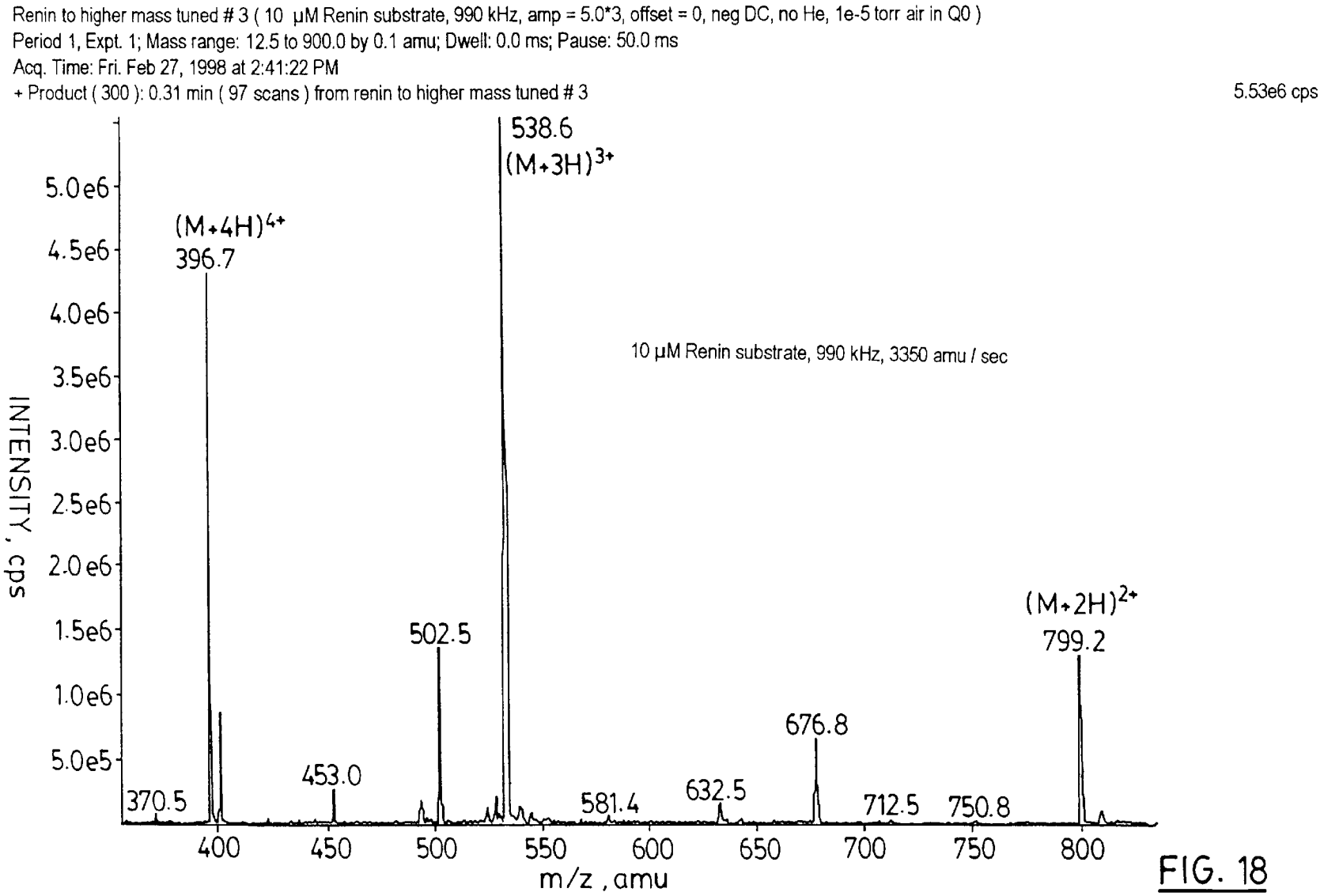
FIG. 18 shows a further mass spectrum obtained using a modification of the FIG. 10 apparatus.

FIG. 18 shows a mass spectra for renin substrate, again obtained using the FIG. 10 arrangement as just described, with no cooling gas in the Q2 rods, pre-trapping in the Q0 rods, and resolving DC applied to the Q2 rods. The resolution was good (although not as good as in the FIG. 13 spectrum), but the sensitivity was more than $5\times10^6$ counts per second for the $(M+3H)^{3+}$ ion, as compared with only about $2\times10^4$ counts per second for the FIG. 13 spectrum.

Figure 19:
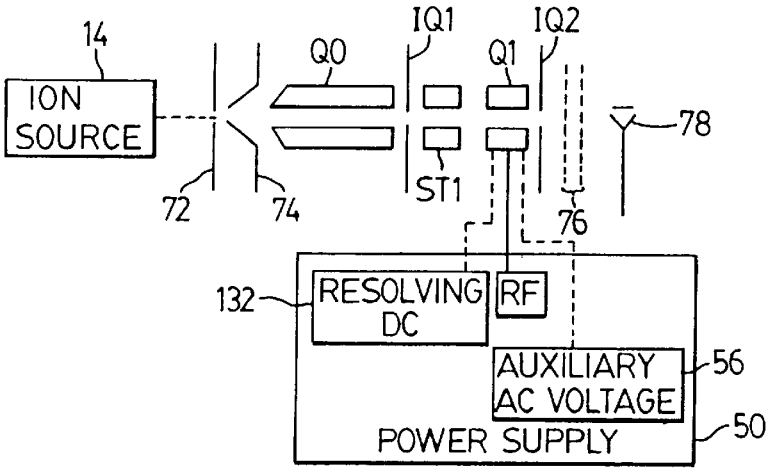
FIG. 19 shows a simplified modification of the FIG. 10 apparatus.

The FIG. 10 arrangement, operated without cooling gas as described, can be simplified as shown in FIG. 19, in which corresponding reference remarks indicate parts corresponding to those of FIG. 10. As shown, in the FIG. 19 arrangement Q2, ST2 and Q3 have been eliminated. While Q0 is used to accumulate ions during scanning, as before, ions are now trapped in Q1 (instead of in Q2), and are then scanned mass dependently axially out of Q1 past repulsive barrier IQ2. The auxiliary AC may be applied from source 56 either to barrier IQ2, or to the Q1 rods, depending on the mode of operation desired (the second arrangement is shown). The ions axially scanned from Q1 are focussed by exit lens 76 into detector 78 for recording of the ion count. Resolving DC is applied to the Q1 rods as before, but since the Q1 rods are only one inch long, as compared with the 5 inch rods used in FIG. 10, and since their dimensional tolerances need not be high, they are quite inexpensive. Nevertheless, essentially the same sensitivity and resolution can be achieved with the FIG. 19 arrangement as with the FIG. 10 arrangement.

Figure 20:
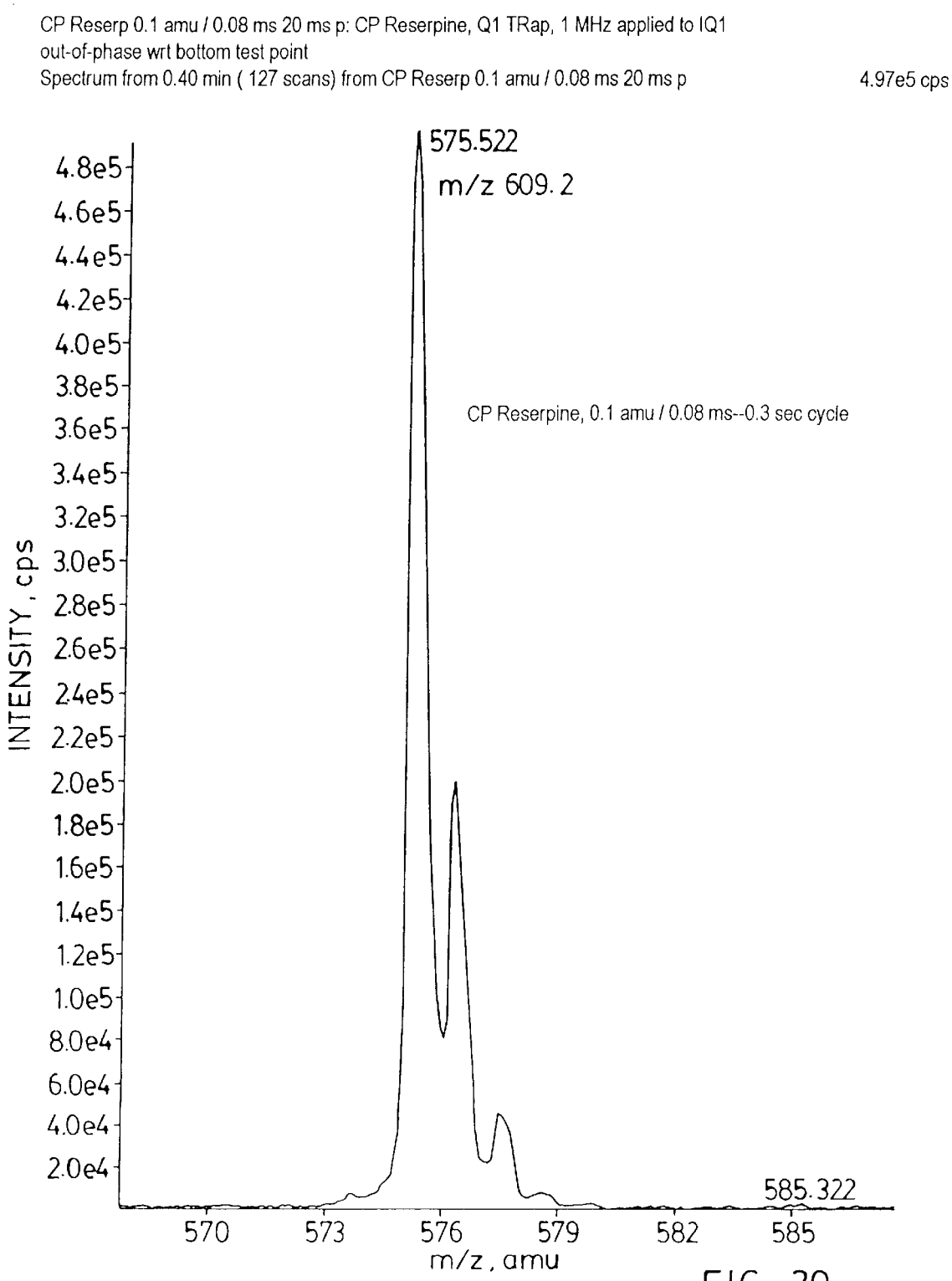
FIG. 20 shows a mass spectrum obtained using the FIG. 19 apparatus.

To demonstrate this, reference is made to FIG. 20, which shows a mass spectrum obtained for reserpine, using the FIG. 19 arrangement and with 1.0 MHz RF, and 3.0 volts resolving DC applied to the Q1 rods. No auxiliary AC was applied to the Q1 rods nor to IQ2 so the mass selective axial ion ejection occurred at approximately q=0.9. It will be seen that the sensitivity for mass 609 was more than $4.8\times10^5$ cps, and the resolution was reasonably good.

Figure 21:
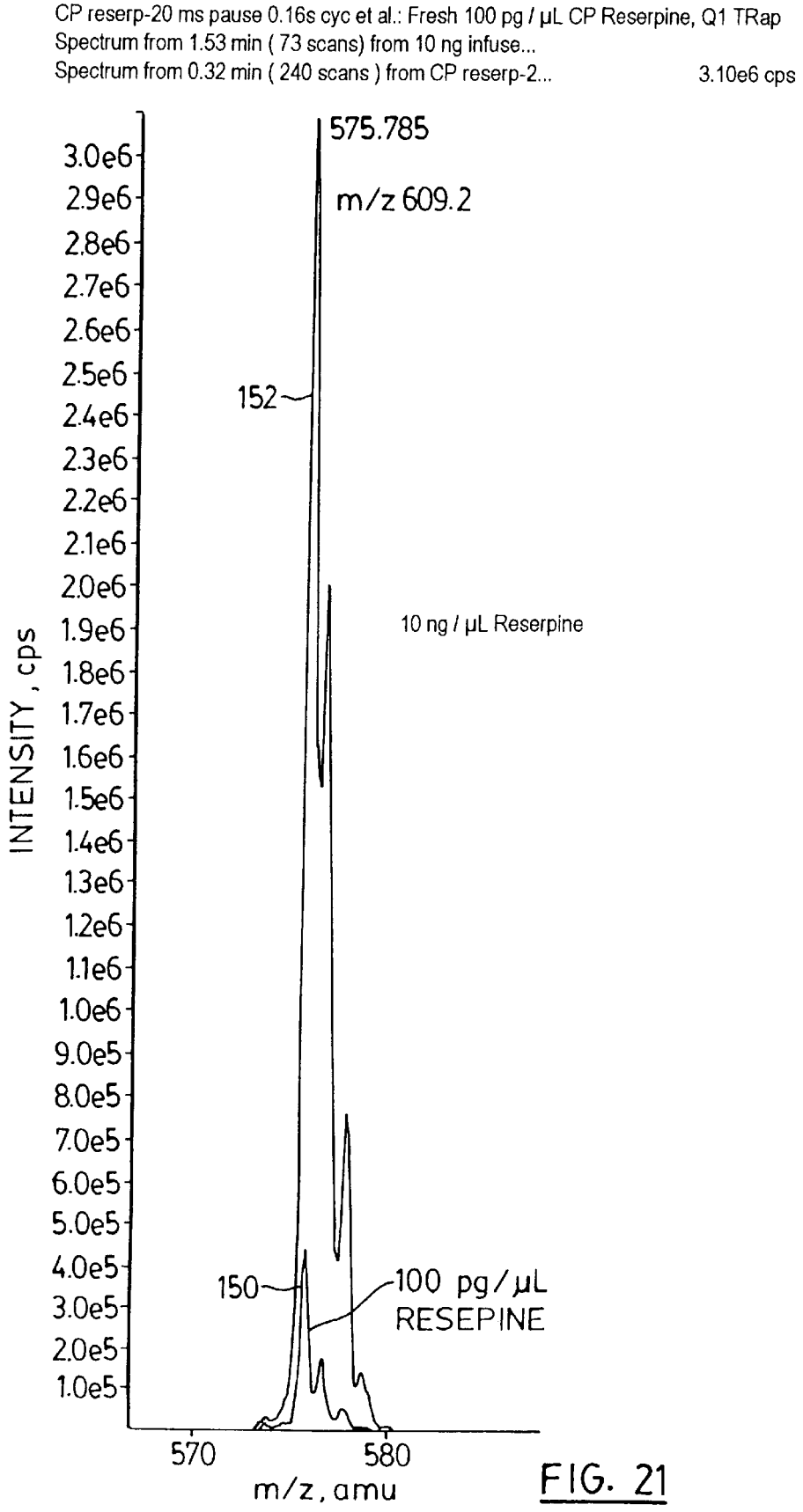
FIG. 21 shows two additional mass spectra obtained using the FIG. 19 apparatus.

FIG. 21, which shows two spectra for reserpine made using the FIG. 19 arrangement, demonstrates that space charge effects did not cause difficulty even with the very short one inch trapping rods of Q1. In FIG. 21, peak 150 identifies mass 609 for 100 pg/μL reserpine, while peak 152 identifies the corresponding peak (mass 609) for 10 nanograms/μL reserpine. Had space charge effects been present, the peak 152 at the higher concentration would have moved and broadened, but this has not occurred despite the fact that the ion detection electronics have been saturated by the response from the 10 nanogram/μL solution.

In summary at this point, it will be seen that scanning with the FIG. 10 arrangement using cooling gas allows very high resolution, although at relatively modest scan rates. Scanning without cooling gas offers less resolution, but provides resolution which is acceptable in most applications, with higher sensitivity and faster scanning.

An advantage of the methods described is that a conventional commercially viable mass spectrometer, such as the model API 300 illustrated in simplified form in FIG. 4, can be operated using at least some of the methods. This can produce 10 times the signal intensity and at least the same resolution, simply by changing the previously used operating procedure. Alternatively, since in a standard model API 300 mass spectrometer Q0 obtains its RF from Q1 and therefore is forced to scan when Q1 scans, Q0 can be supplied with separate RF so it can accumulate and pre-trap ions while Q1 is scanning ions out axially in a mass dependent manner.

Figure 22:
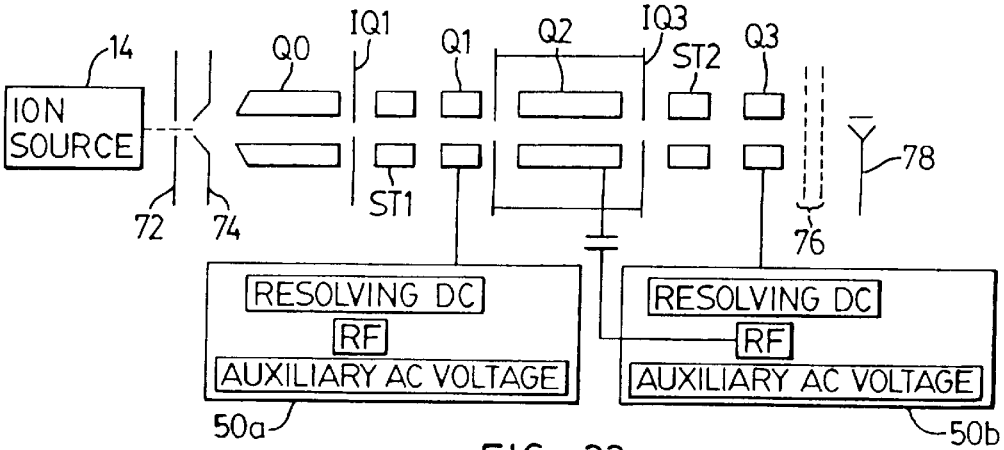
FIG. 22 shows a modification of the FIG. 10 apparatus used for MS/MS.

A modification of the FIG. 10 arrangement, shown in FIG. 22, can also be used to perform MS/MS. In this mode of operation, ions are pre-trapped in Q0 by a suitably repulsive voltage on lens IQ1, and are then at appropriate times pulsed into Q1, which acts as a trap (without added cooling gas), with a repulsive voltage on lens IQ2 to trap ions in Q1. RF is applied directly to Q1 from power source 50 for this purpose, together with a small amount of resolving DC for the purpose described.

Ions (parent ions) trapped in Q1 are mass dependently scanned axially out of Q1 into Q2, which contains collision gas (from a source not shown) to dissociate the parent ions or fragment them, to produce fragment ions.

The ions in Q2, namely a mixture of fragment and parent ions, are permitted to leave Q2 under the influence of the rod offset voltages and enter Q3, where they are trapped by a repulsive DC voltage applied to one of the lenses 76. The mixture of trapped ions in rods Q3 is then axially scanned out mass selectively for detection by detector 78 and recording of the ion count. Separate auxiliary AC voltages may be applied to the Q1 and Q3 rods, from power supplies 50*a*, 50*b*, either as dipole or quadrupole voltages, as described and as shown in FIG. 22. Alternatively, separate auxiliary AC voltages may be applied to lenses IQ2 and 76 for the purposes described. Provided that the RF frequency is an integral multiple of the auxiliary AC frequency, the AC frequency can be synchronized and phase locked to the RF frequency. Note that the AC and RF frequencies are fixed while the RF amplitude is scanned.

As an alternative, the mixture of fragment and parent ions in Q2 can be trapped there by a suitably repulsive voltage on lens IQ3. The trapped mixture can then be scanned axially mass dependently out of Q2, through ST2 and Q3 (which now are in RF-only mode and act as an ion pipe) into the detector 78. In this mode of operation, the resolution will be higher than previously described, due to the gas in the trapping rods Q2.

Figure 23:
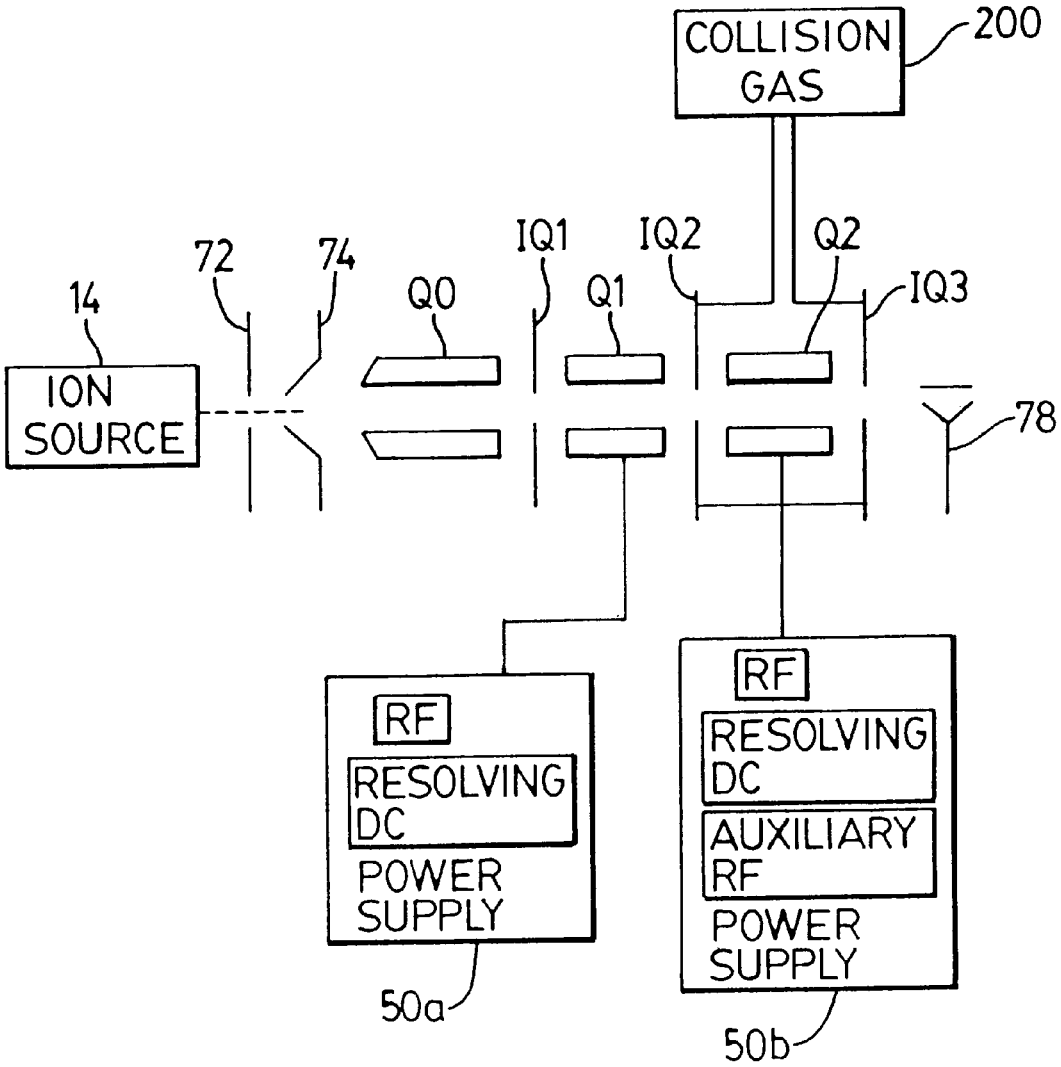
FIG. 23 shows another modification of the FIG. 10 apparatus used for MS/M.

Yet another approach for performing MS/MS is based on the apparatus in FIG. 23. Ions are pre-trapped in Q0 by a suitable repulsive voltage on lens IQ1, and are then at appropriate times pulsed through Q1. Q1 is a standard RF/DC quadrupole mass analyzer, with its own power supply 50*a* to supply RF and resolving DC thereto, and is not operated as an ion trap. The RF and DC voltages applied to Q1 are chosen to transmit the parent ions of interest into Q2, with other ions being lost radially in the usual and well understood manner. Q2 contains collision gas from source 200 to dissociate the parent ions or fragment them, to produce fragment ions. The fragment ions and residual parent ions are trapped in Q2 by a repulsive DC voltage applied to lens IQ3, in the manner previously described. RF, a small amount of resolving DC, and auxiliary AC are applied to the Q2 rods as previously described. The ions trapped in Q2 are then scanned axially out of Q2 mass selectively toward the detector 78, yielding an MS/MS mass spectrum.

There are several advantages of the configuration described in connection with FIG. 23. Firstly, the mass isolation step of the parent ion is very simply and rapid. It simply involves passing the ions extracted from Q0 through the conventional resolving mass spectrometer Q1. This eliminates the rather long times (milliseconds) involved when parent ions are isolated within an ion trap. Furthermore, the capability to perform conventional RF/DC scans with Q1 remains, which simplifies the operation while retaining the advantages of ion trapping and increased duty cycles. It is understood that the first stage of mass spectrometry (here done with Q1) need not be accomplished using a quadrupole mass filter. Any mass filter device such as a time-of-flight mass spectrometer, an RF-only quadrupole, or a single or double focusing sector mass spectrometer would be effective in the parent ion isolation step. In addition, fragment ions scanned from Q2 can be further fragmented by the method described, yielding further stages of MS.

Figure 24:
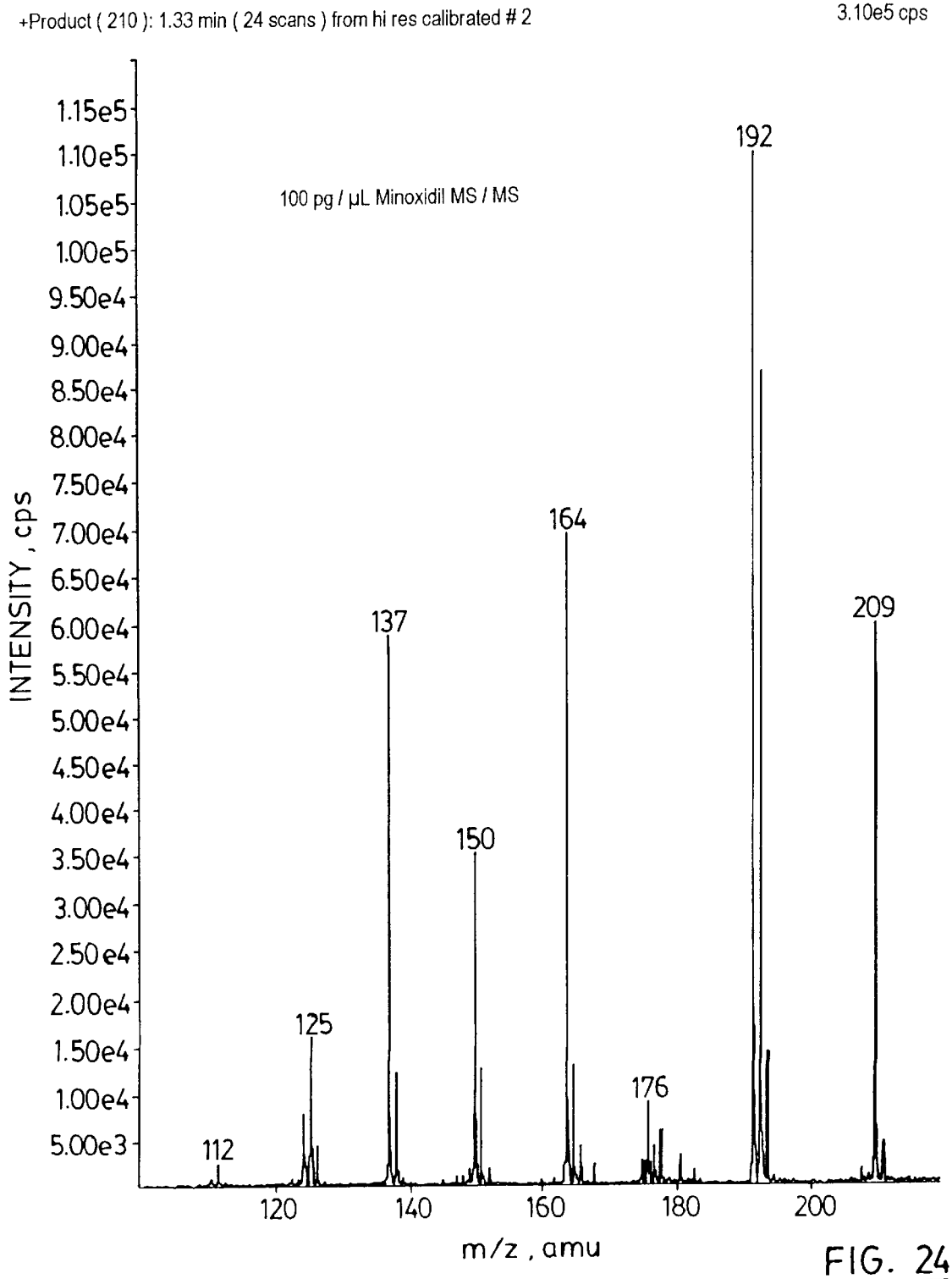
FIG. 24 shows a mass spectrum obtained using the FIG. 23 appartus.

FIG. 24 shows an MS/MS spectrum obtained with the apparatus described in FIG. 23. Here, a 100pg/μL solution of minoxidil (molecular weight 209) is introduced into the ion source 14. Q1 was set to transmit a 3 amu wide window centered at m/z 209 into the pressurized Q2 which acts as an ion trap. An auxiliary AC voltage at a frequency of 500 kHz phase locked to the 1 MHz drive RF was applied to the Q2 rods in a quadrupole fashion. The AC voltage was 6 V(p—p). 1 V of resolving DC was also applied to the Q2 rods. The collision gas supplied from source 200 was nitrogen at a pressure of approximately $3\times10^{-4}$ Torr, approximately 10 to 50 times less than that currently used in commercial triple quadrupole mass spectrometers such as that sold by MDS Inc. under the name API 300.

The spectrum in FIG. 24 shows all of the expected minoxidil fragment ions at high sensitivity and peak width of <0.15 amu measured at half height. This resolution is very good.

The fact that very low collision gas pressure can be employed in the FIG. 23 apparatus means that small, less expensive vacuum pumps can be used. This and the fact that the apparatus in FIG. 23 employs only one high precision mass filter in the Q1 position as apposed to two such mass filters in a conventional triple quadrupole mass spectrometer represents a significant cost reduction.

It is noted that while previously in this description, Q2 in FIGS. 4 and 10 was described as operating at approximately one milli-Torr of collision gas pressure, the pressure in those cases may also be reduced significantly, e.g. to $3\times10^{-4}$ Torr. While this pressure is lower than that required for operation in the conventional collisional focusing regime, experiments have shown that this low collision gas pressure is adequate to produce good results.

Figure 7:
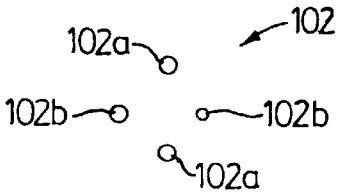
FIG. 7 is an end view of rods which can be used as an exit lens.

While the invention has been described in connection with a quadrupole rod structure, other multipole rod geometries may be used, for example octopoles and hexapoles. In addition, although the exit lens 42 has been described as a plate with an aperture, other configurations of exit lenses may be used, for example a short RF-only rod array such as that indicated at 102 in FIG. 7 and having A and B poles 102*a*, 102*b*. The rod offsets of the A and B poles 102*a*, 102*b* may then be resonated at the resonance frequency of the ion to be ejected, producing axial ejection as was achieved by the auxiliary AC field applied to exit lens 42.

Figure 8:
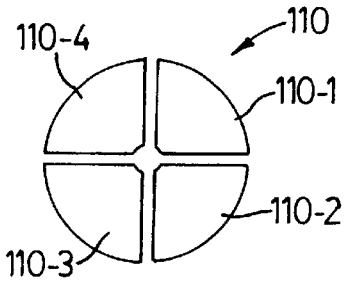
FIG. 8 is a plan view of a modified exit lens.

While linear rod sets have been described and illustrated, if desired curved rod sets may be used. In addition, while end lenses in the form of a perforated plate, or a short set of rods, have been shown, other forms of end lenses may be used. For example, as shown in FIG. 8, the end lens 110 may be a segmented plate having wedge-shaped segments 110-1, 110-2, 110-3, 110-4 and an aperture 112. This allows different fields to be applied to each segment, to optimize the results, while still limiting the quantity of gas which can leave the part of the vacuum chamber upstream of lens 110.

While preferred embodiments of the invention have been described, it will be appreciated that various changes may be made within the scope of the invention, and all such changes are intended to be included in the accompanying claims.

What is claimed is:

1. A method of operating a mass spectrometer having an elongated rod set, said rod set having an entrance end and an exit end and a longitudinal axis, said method comprising:

(a) admitting ions into said entrance end of said rod set, (b) trapping at least some of said ions in said rod set by producing a barrier field at an exit member adjacent to the exit end of said rod set and by producing an RF field between the rods of said rod set adjacent at least the exit end of said rod set, (c) said RF and barrier fields interacting in an extraction region adjacent to said exit end of said rod set to produce a fringing field, (d) energizing ions in said extraction region to mass selectively eject at least some ions of a selected mass to charge ratio axially from said rod set past said barrier field, (e) and detecting at least some of the axially ejected ions.

2. A method according to claim 1 wherein said barrier field is a DC field.

3. A method according to claim 2 wherein an auxiliary AC voltage is applied to said exit member.

4. A method according to claim 3 wherein, in said step (d), said auxiliary AC voltage is scanned.

5. A method according to claim 1 or 2 wherein a DC offset voltage is applied to said rods, and in said step (d), said DC offset voltage is modulated at a frequency to excite selected ions whereby selected ions are mass dependently ejected axially past said barrier field.

6. A method according to claim 1, 2 or 3 wherein, in said step (d), said RF field is scanned.

7. A method according to claim 1, 2 or 3 wherein, in said step (d), the amplitude of said RF field is scanned.

8. A method according to claim 1, 2 or 3 wherein, in said step (d), a supplementary AC voltage is applied between the rods of said rod set.

9. A method according to claim 1, 2 or 3 wherein, in said step (d), a supplementary AC voltage is applied between the rods of said rod set and said supplementary AC voltage is scanned.

10. A method according to claim 1, 2 or 3 wherein, in said step (d), a supplementary AC voltage is applied between the rods of said rod set, said supplementary AC voltage being fixed and said RF field being scanned.

11. A method according to claim 3 or 4 wherein said auxiliary AC voltage has a frequency which is synchronized and phase locked to the frequency and phase of said RF field.

12. A method according to claim 1, 2 or 3 and including the step of applying an axial field along said axis of said rod set.

13. A method according to claim 1, 2 or 3 and including the step of providing a low pressure gas between the rods of said rod set for collisional focussing and cooling of ions therein.

14. A method according to claim 1, 2 or 3 and including the step of providing said ions from an ion source, providing a second rod set between said first mentioned rod set and said ion source, pre-trapping ions in said second rod set, and selectively admitting ions from said second rod set into said first mentioned rod set for axial ejection from said first mentioned rod set and consequent detection.

15. A method according to claim 1, 2 or 3 and including the step of ejecting radially from said rod set at least some ions outside a selected mass range of interest, before said step of axially ejecting ions.

16. A method according to claim 1 and including the step, before axially ejecting said ions, of exciting said ions to dissociate at least some of said ions.

17. A method according to claim 16 wherein said ions are excited by applying an axial field to said ions and oscillating said axial field.

18. A method according to claim 1, 2 or 3 wherein, at the same time as ions are being admitted into said entrance end of said rod set, ions are being mass selectively ejected axially from said exit end of said rod set, past said barrier field.

19. A method according to claim 1 wherein a resolving DC voltage is applied to said rod set at least during the step of mass selectively ejecting ions axially from said rod set past said barrier field, thereby to increase the sensitivity of said method.

20. A method according to claim 19 wherein said resolving DC is at least 0.5 volts.

21. A method according to claim 19 wherein said resolving DC is between about 0.5 volts and 50 volts.

22. A method according to claim 1 wherein a supplementary AC field is applied to said rod set at a frequency which is at least twice the secular frequency of said ions of said selected mass.

23. A method according to claim 1 wherein an auxiliary AC voltage is applied to said exit member at a frequency which is at least twice the secular frequency of said ions of said source and mass.

24. A method according to claim 22 or 23 wherein said frequency is twice said secular frequency.

25. A method according to claim 22 or 23 wherein a resolving DC voltage is applied to said rod set at least during the step of mass selectively ejecting ions axially from said rod set, thereby to increase the sensitivity of said method.

26. A method according to claim 1, 19, 22 or 23 wherein said rod set is evacuated to a low pressure to reduce collisional cooling of ions therein, thereby to reduce space charge effects within said rod set and thereby increasing the sensitivity of said method.

27. A method according to claim 1, 19, 22 or 23 and including the step of applying said RF to said rod set directly from a power supply, thereby to obtain independent control of the amplitude and frequency of the RF applied to said rod set.

28. A method according to claim 1, 19, 22 or 23 wherein said rod set is approximately one inch in length.

29. A method according to claim 1 wherein an auxiliary AC field applied to said exit member.

30. A method according to claim 29 wherein, in said step (d), said uxiliary AC voltage is scanned.

31. A method according to claim 30 wherein said auxiliary AC voltage has a frequency which is synchronized and phase locked to the frequency and phase of said RF field.

32. A method of operating a mass spectrometer having a plurality of elongated rod sets in series, each rod set having a longitudinal axis, and thereby providing MS/MS, said method comprising:

(a) emitting ions from an ion source into one said rod set, (b) pre-trapping ions in said one rod set, (c) selectively pulsing ions from said one rod set into a second said rod set, said second rod set having entrance and exit ends, (d) trapping at least some of said ions in said second rod set by producing a barrier field at an exit member adjacent to the exit end of said second rod set and by producing an RF field between the rods of said second rod set adjacent to at least the exit end of said second rod set, (e) said RF and barrier fields interacting in an extraction region adjacent to said exit end of said second rod set to produce a fringing field, (f) energizing ions in said extraction region to mass selectively eject at least some ions of a selected mass to charge ratio axially from said second rod set past said barrier field, said ejected ions being parent ions, (g) transmitting said parent ions into a third said rod set containing a collision gas, and fragmenting said parent ions in said third rod set to form fragment ions, (h) and mass dependently ejecting at least said fragment ions axially from a said rod set for detection.

33. A method according to claim 32 wherein said ions are mass dependently scanned axially from said third rod set.

34. A method according to claim 32 wherein fragment ions in said third rod set are transmitted into a fourth said rod set, said fourth said rod set being maintained at a low pressure to minimize collisional cooling ions therein, said fragment ions being mass dependently scanned axially from said fourth rod set for detection.

35. A method of operating a mass spectrometer having a plurality of elongated rod sets in series, each rod set having a longitudinal axis, and thereby providing MS/MS, said method comprising:

(a) emitting ions from an ion source into one said rod set, (b) pre-trapping ions in said one rod set, (c) selectively pulsing ions from said one rod set into a resolving mass spectrometer having an exit end, and operating said resolving mass spectrometer to transmit ions of a selected mass to charge ratio, such ions being parent ions, (d) transmitting said parent ions into a second set rod set containing a collision gas, and fragmenting said parent ions in said second rod set to form fragment ions, (e) and trapping at least said fragment ions in, and mass dependently ejecting at least said fragment ions axially from, a said rod set for detection.

36. A method according to claim 35 wherein said ions are trapped in and mass dependently scanned axially from said second rod set.

37. A method according to claim 35 or 36 wherein said collision gas is at a pressure below that required for collisional focusing.

38. A method of operating a mass spectrometer having one or more elongated rod sets each having a longitudinal axis, to provide MS/MS, said method comprising:

(a) emitting ions from an ion source, (b) admitting at least some of said ions into a revolving mass spectrometer and operating said resolving mass spectrometer to transmit at least some ions of a selected mass to charge ratio, such transmitted ions being parent ions, (c) transmitting said parent ions into one said rod set containing a collision gas, and fragmenting said parent ions in said one rod set to form fragment ions, (d) and trapping at least said fragment ions in, and mass dependently ejecting at least said fragment ions axially from, a said rod set for further processing or detection.

39. A method according to claim 38 wherein said ions are trapped in and mass dependently scanned axially from said one rod set.

40. A method according to claim 38 wherein fragment ions in said one rod set are transmitted into a second said rod set, said second said rod set being maintained at a low pressure to minimize collisional cooling of ions therein, said fragment ions being trapped in and mass dependently scanned axially from such second rod set for detection.

41. A method of operating a mass spectrometer having an elongated rod set, said rod set having an entrance end and an exit end and a longitudinal axis, said method comprising:

(a) admitting ions into said entrance end of said rod set or forming ions of interest therein, (b) trapping at least some of said ions in said rod set, (c) and mass dependently ejecting at least some of said ions of a selected mass to charge ratio axially from said rod set for further processing or detection.

42. A mass spectrometer system comprising:

(a) an ion source;

(b) a main rod set having an entrance end for admitting ions from the ion source and an exit end for ejecting ions traversing the longitudinal axis of the main rod set;

(c) an exit member adjacent to the exit end of the main rod set;

(d) power supply coupled to the main rod set and the exit member for producing an RF field between rods of the main rod set and a barrier field at the exit end, whereby in use (i) at least some of the ions admitted in the main rod set are trapped within the rods and (ii) the interaction of the RF and barrier fields products a fringing field adjacent to the exit end, (e) an AC voltage source coupled to one of: the rods of the main rod set; and the exit member, whereby the AC voltage mass dependently and axially ejects ions trapped in the vicinity of the fringing field from the exit end; and (f) a detector for detecting at least some of the axially ejected ions.

43. A mass spectrometer system as claimed in claim 42, including an upstream rod set, and a lens between the upstream rod set and the main rod set, whereby the upstream rod set functions as an ion trap, for trapping ions, thereby enabling pulses of ions to be admitted to the main rod set.

44. A mass spectrometer system as claimed in claim 43, including a power supply for supplying resolving DC, RF and auxiliary AC voltages to the upstream rod set, whereby ions can be mass selectively scanned out of the upstream rod set into the main rod set.

45. A mass spectrometer system as claimed in claim 44, which includes means for supplying a collision gas to the main rod set, whereby the main rod set functions as a collision cell.

46. A mass spectrometer system as claimed in claim 45, including a downstream rod set and a detector, both provided downstream from the main set, and power supply means for supplying resolving DC, RF and an auxiliary AC voltage to the downstream rod set, whereby, in use, ions are passed from the main rod set into the downstream rod set, and ions are mass selectively scanned out of the downstream rod set for detection.

47. A mass spectrometer system as claimed in claim 42, which includes first and second upstream rod sets, with the second upstream rod set being provided between the first upstream rod set and the main rod set, and power supply means for supplying RF and resolving DC voltages, connected to both of the first and second upstream rod sets, wherein a lens is provided between the first and second upstream rod sets whereby ions can be trapped and release in pulses from the first upstream rod set and ions can be mass selected in the second upstream rod set.

48. A mass spectrometer system as claimed in claim 47, wherein the main rod set is mounted in a collision cell and the apparatus includes means for providing a collision gas, for collision-induced dissociation in the main rod set.

* * * * *